US005194681A

United States Patent [19]

Kudo

[11] Patent Number: 5,194,681

[45] Date of Patent: Mar. 16, 1993

[54] MUSICAL TONE GENERATING APPARATUS

[75] Inventor: Masaki Kudo, Hamamatsu, Japan

[73] Assignee: Yamaha Corporation, Hamamatsu, Japan

[21] Appl. No.: 585,381

[22] Filed: Sep. 20, 1990

[30] Foreign Application Priority Data

Sep. 22, 1989 [JP] Japan ..... 1-247665
Oct. 4, 1989 [JP] Japan ..... 1-259734

[51] Int. Cl.[5] ..... G10H 7/12

[52] U.S. Cl. ..... 84/603; 84/607; 364/723

[58] Field of Search ..... 84/603-607, 84/622-625, DIG. 9; 364/723, 724.1

[56] References Cited

U.S. PATENT DOCUMENTS 4,719,833 1/1988 Katoh et al. ..... 364/723 X
4,907,484 3/1990 Suzuki et al. ..... 84/DIG. 9

FOREIGN PATENT DOCUMENTS 59-17838 4/1984 Japan .
60-161505 8/1985 Japan .
63-168695 7/1988 Japan .

*Primary Examiner*—Stanley J. Witkowski

*Attorney, Agent, or Firm*—Spensley Horn Jubas & Lubitz

[57] ABSTRACT

A tone generated by a tone source is converted to an electric signal and this electric signal is sampled. The converted digital data are stored in a first memory, and parts which are to become a initial portion and a repeating portion of a waveform of the tone source are extracted from the data in the first memory. Next, the attack end sample AES, which is the end of the initial portion, is determined. and a loop-in point (a point at which transfer from the initial portion to the repeating portion is accomplished) LIP which is in agreement with this attack end sample is obtained. Then, the loop end sample LES, which is the end of the repeating portion, is determined, and a loop start point (beginning of the repeating portion) LSP which is in agreement with this loop end sample LES is obtained. Alternatively, the beginning of the repeating portion is determined, and an end of the repeating portion or an end of the initial portion which is in agreement with this is obtained. Data are read out from the first memory in accordance with addresses corresponding to the beginning and the end of the repeating part obtained in the above manner, and these are written to a second memory. At this time, in the case in which addresses necessary for interpolation processing are obtained, reading and writing processes are carried out in accordance with the addresses used for interpolation.

9 Claims, 18 Drawing Sheets

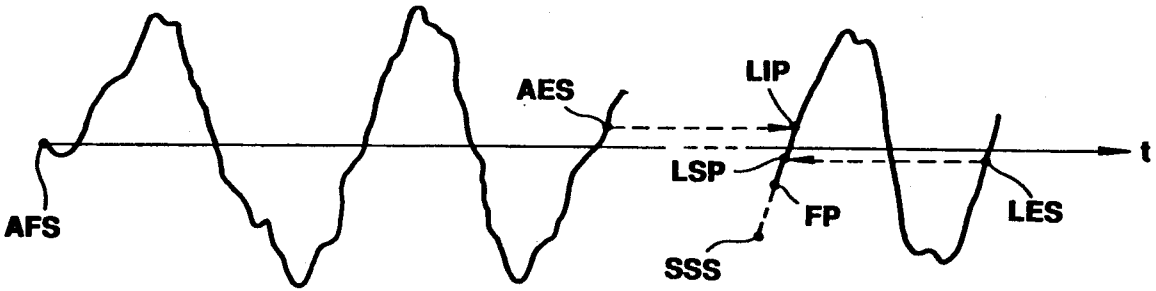
FIG.3 (b)
FIG.3(a)
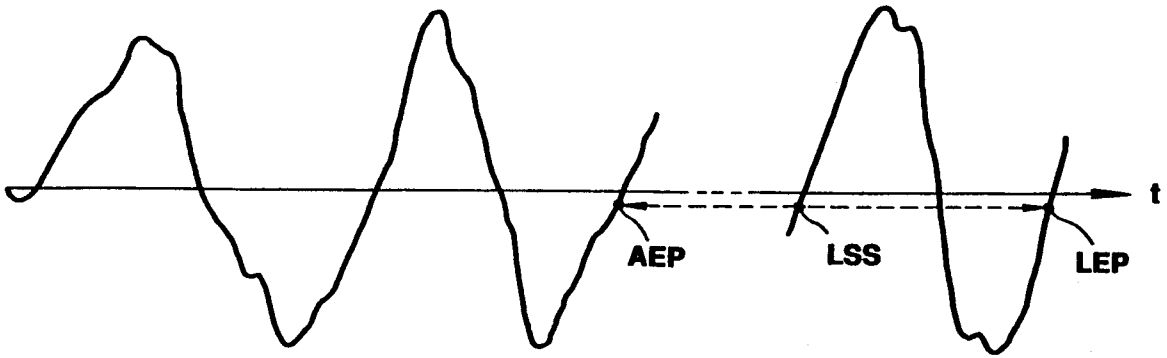
FIG.7 (b)
FIG.7 (a)

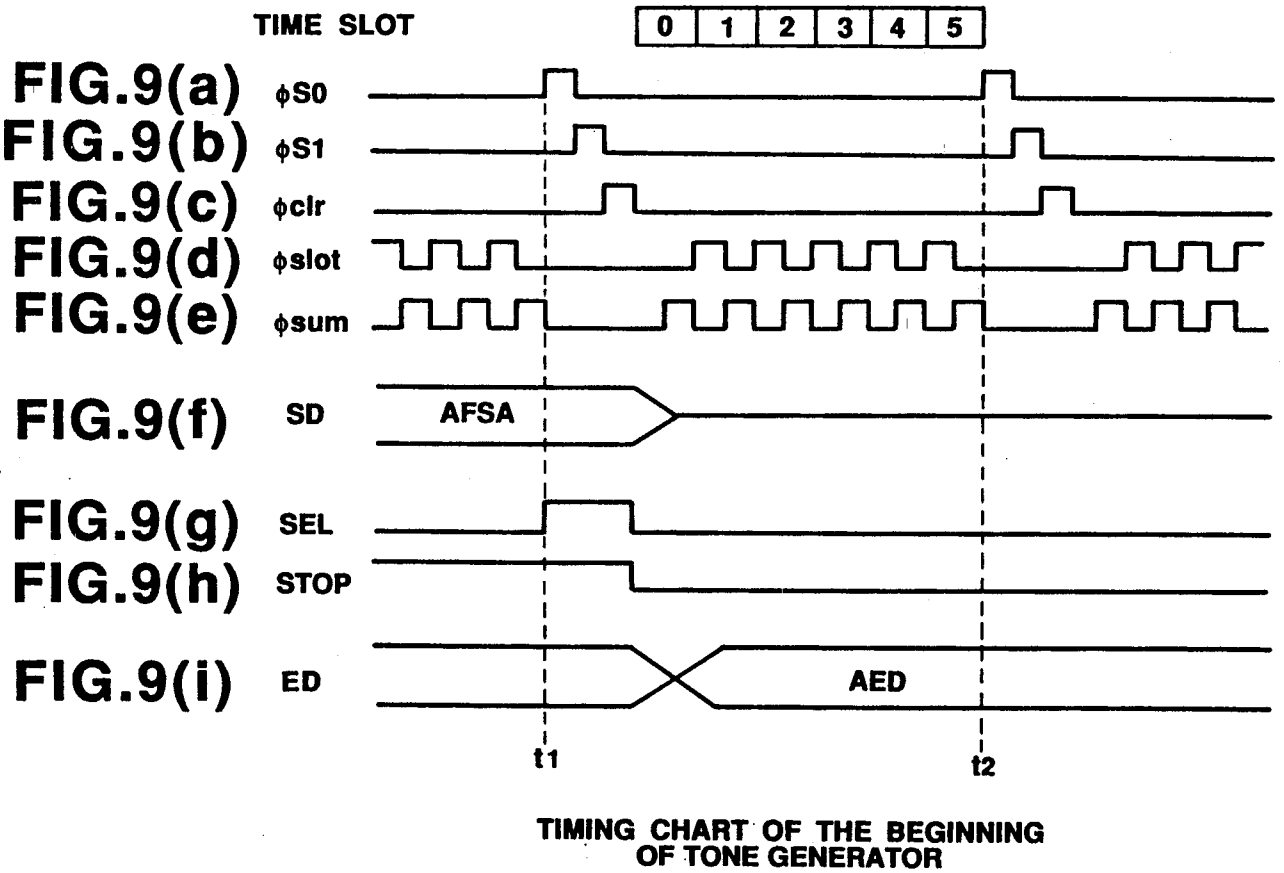
TIMING CHART OF THE BEGINNING OF TONE GENERATOR

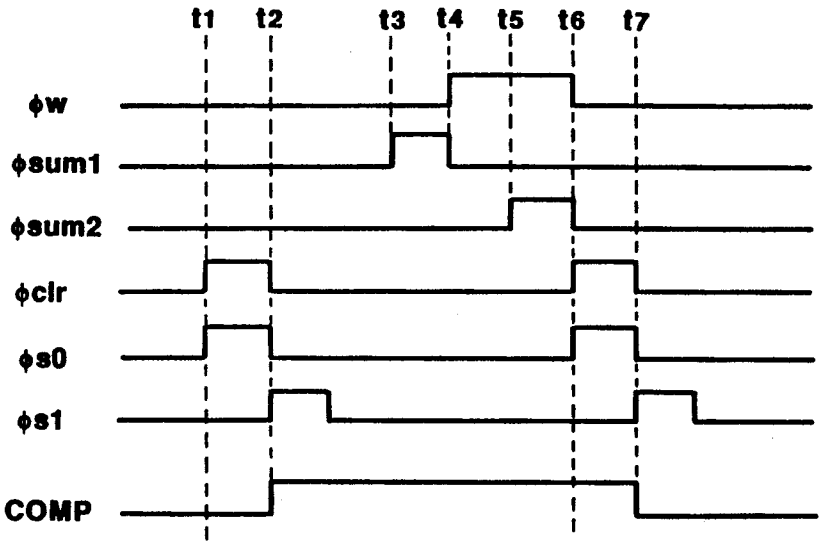
FIG.15(a)
FIG.15(b)
FIG.15(c)
FIG.15(d)
FIG.15(e)
FIG.15(f)
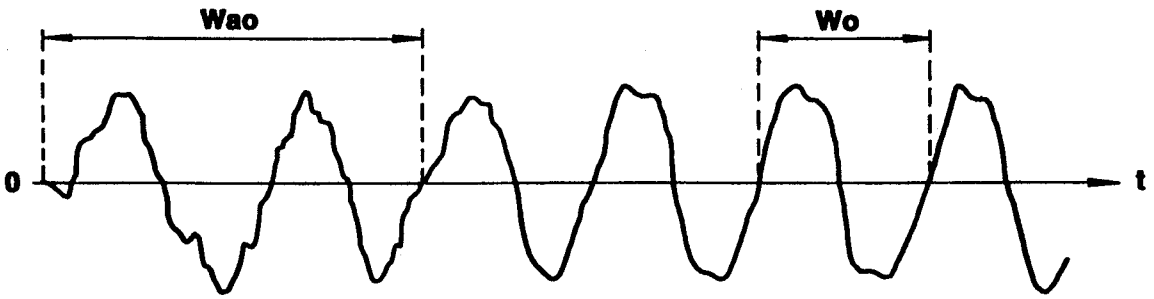
FIG.21

FIG.22(a) TONE SOURCE
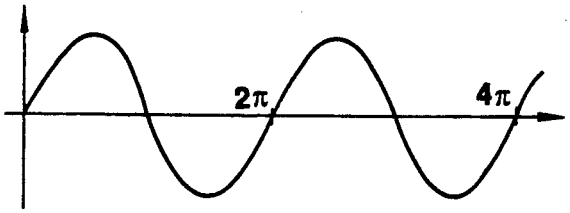
FIG.22(b) SAMPLE PULSE (fs = fs1)
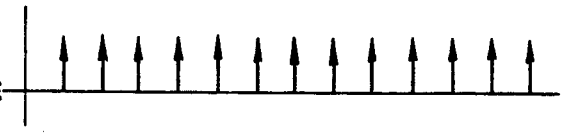
FIG.22(c) SAMPLED TONE SOURCE
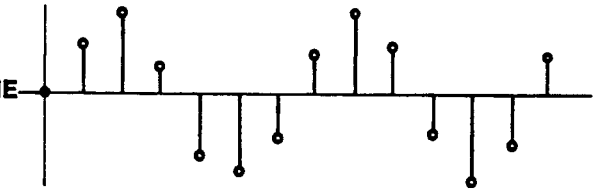
FIG.22(d) INTERPOLATION
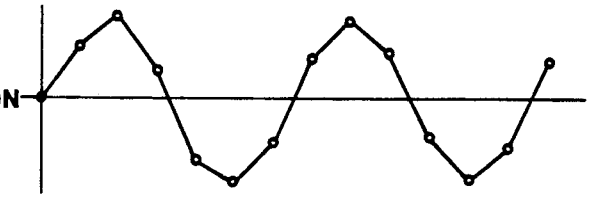
FIG.22(e) RESAMPLE (fs = fs2 ≠ fs1)
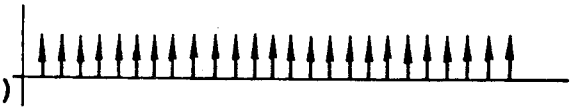
FIG.22(f)
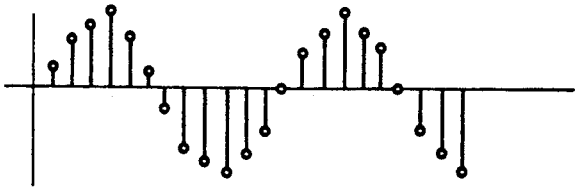
FIG.22(g)
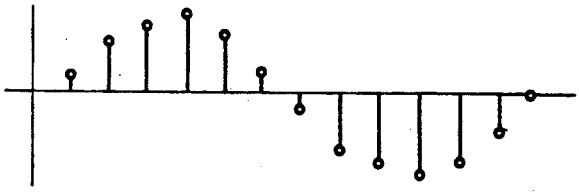

MUSICAL TONE GENERATING APPARATUS

FIELD OF THE INVENTION

This invention relates to a recording and regeneration method for tone source waveforms used in electronic musical devices and the like and a regeneration apparatus.

BACKGROUND OF THE INVENTION

The conventionally known electronic musical instrument provides a waveform memory which pre-stores a musical tone waveform generated from a non-electronic musical instrument (hereinafter, simply referred to as "acoustic instrument") and the like. When a musical tone waveform is stored in the waveform memory, the tones of an acoustic musical instrument are converted to electric signals by means of a microphone, and the value of these electric signals is sampled at every moment, converted into digital data, and stored in memory. When musical tones are formed, the data in memory are read at a speed which corresponds to the pitch of the key which has been operated, these data are converted to an analog signal, and a tone is generated from a speaker.

When the entire musical tone waveform from the beginning of tone generation to the end thereof is stored in memory, the contents of the memory become considerably large. As the initial portion of the waveform changes in a complicated manner, the entire waveform is stored in memory, and as in the continuing and decreasing portions of the waveform a relatively monotonous waveform is repeated, a waveform of the duration of only one cycle (or a plurality of cycle) is stored in memory, and this waveform is repeatedly read and a musical tone is thus formed (looping processing). FIG. 21 shows one example of a musical tone waveform; in the drawing, Wao is the initial portion, and the other portion is the continuing portion. In the partial waveform memory method, the entirety of the initial portion Wao is stored in memory, and a single suitable cycle Wo is stored in memory as a repeating portion for the continuing portion.

A supplementary-pitch non-synchronous tone source is an example of an application of this partial waveform memory method. This tone source has advantages in that the waveform memory size can be kept small and there is no need to increase the address transfer speed of the waveform memory. Here, a tone source according to this method will be explained.

FIG. 22(*a*) is a waveform diagram of the tone source. First, the tone source is sampled by a sampling pulse of the fixed frequency (fs=fs1) shown in FIG. 22(*b*), and stored in memory. As a result, the waveform data shown in FIG. 22(*c*) are stored in memory. Next, the waveform data shown in FIG. 22(*d*) are interpolated (the diagram shows a linear straight-line interpolation) and resampled at a frequency fs2 (fs2 is not equal to fs1); the post-interpolation waveform data are then read. In other words, by resampling at a frequency of fs2 which is different from the frequency fs1, a change in the virtual sampling frequency is effected (see FIG. 22(*f*)). Next, when fs2 is made the same frequency as fs1, a tone having a new pitch is generated (see FIG. 22(*g*)).

In this way, it is possible to obtain a tone of a desired pitch from a limited sample; moreover, there is an advantage in that it is not necessary to create a sampling pulse which is synchronous with the pitch of the tone.

SUMMARY OF THE INVENTION

In the above-mentioned partial waveform memory method, it is desirable that the final sampling data of the initial portion Wao and the initial sampling data of the repeating portion Wo, as well as the initial and final sampling data of repeating portion Wo be in agreement. However, in conventional methods, no special consideration is given to this agreement, and as a result, there has been a problem in that slight gaps occur at the times of connection of the end of initial portion Wao and the beginning of repeating portion Wo, and the beginning and end of repeating portion Wo.

Furthermore, there have been the following problems during the looping processing time in pitch-non-synchronous method tone sources. Here, for the purpose of explanation, a comparison will be made with looping processing in a pitch-synchronous method.

In a pitch-synchronous method, for example, as is shown in FIG. 23(*a*), in the case in which the original waveform (an analog waveform) is repeated, the sampling data are as shown in FIG. 23(*b*). In this case, only the waveform data of one fixed cycle, for example, the cycle from point a to point b, are stored, and when the reading address comes to point b, it again returns to point a and reading is carried out. In addition, it is possible to carry out the function of playing in the same way if the waveform data of the one cycle from point a1 to point b1 or the one cycle from point a2 to point b2 are stored and repeatedly read.

Next, the looping processing in a pitch-non-synchronous method will be explained. For example, when the tone source is the waveform shown in FIG. 24(*a*), and the sampling timing is as shown in FIG. 24(*b*), the sampled waveform data will be as shown in FIG. 24(*c*). In addition, the data resulting from the straight-line interpolation of the waveform data of FIG. 24(*c*) are as shown in FIG. 24(*d*). Here, the time t(x) in the drawing is made the starting point of the repetition, and the time t(x+T) (T is the period of the repetition), reached after the loop has been proceeded through beginning with time t(x), is made the ending point of the repetition. At this time, the ending point is almost exactly between sampling points (n+6) and (n+7); however, as waveform data (S+7) is generally not sampled, the waveform data at the endpoint cannot be precisely interpolated.

Accordingly, in the case in which there are no waveform data S(n+7), it is impossible to conduct looping processing precisely and waveform distortions result.

Even if the S(n+7) data are prepared in advance, it is impossible to conduct precise looping processing if consideration is not given to the adjustment between these data and interpolated values in later looping. The reason for this is that as the pitch is non-synchronous, the S(n+7) data have a different value than the S(n) data (see FIG. 24(*c*)), and when after interpolation using S(n+7) has been carried out, the starting point is returned to and interpolation is carried out, aberrations are generated between the interpolated values in the first loop and the interpolated values in the second loop. Furthermore, aberrations are generated in a continuing manner between the second loop and the third loop, and between the third loop and the fourth loop. In addition, these aberrations cause waveform distortion, and moreover, a problem occurs in that the manner of the generation of these distortions changes with each loop. In the case of the above-mentioned pitch-simultaneous method, as FIG. 23(*b*) shows, if the beginning and ending points of the original waveform are equal, the above-mentioned type of problem does not occur even if looping is carried out.

The first purpose of the present invention is to prevent the gaps in the connection between the initial portion Wao and the repeating portion Wo and between the beginning and end of repeating portion Wo.

According to the present invention, the beginning point of the repeating portion is determined, and the ending point of the repeating portion which is in agreement with this beginning (ending) point is detected while data interpolation is being carried out. Furthermore, based on these beginning and ending points, sampling data is read out of a first memory and stored in a second memory, and by means of the reading of these stored data, the reproduction of the tone-source waveform is carried out. By means of this, the ending point of the initial portion and the beginning point of the repeating portion are brought into agreement, and the beginning and ending points of the repeating portion can be brought into agreement. As a result, the noise resulting from the gap between the two points can be prevented.

The second purpose of the present invention is to provide a tone source apparatus which can carry out precise looping processing even with a pitch-non-synchronous method. In order to accomplish this purpose, the apparatus is so constructed as to be provided with:

a waveform memory, which stores waveform data at a fixed sampling spacing;

an address data generator, which renews address data at a spacing corresponding to a frequency of a tone to be generated, accesses said waveform data by means of an integer portion of said address and a following integer of said integer portion, and outputs a fractional portion of said address as interpolation data;

a data interpolation controller, which carries out data interpolation based on two waveform data accessed by means of said address data generator and said interpolation data; and a loop controller, which determines the repeating portion in at least one part of the address space by means of said address data and controls said address data generator so that this repeating portion can be repeatedly accessed; and so that:

said data interpolation controller uses waveform data of a repeating portion end address as waveform data of a repeating portion start address, and uses, in a repeating portion initial section, waveform data of a repeating portion end address and waveform data accessed by means of an integer value which is directly after a repeating portion start address, and corrects said interpolation data in correspondence with the distance between said integer value and said repeating portion start address, and by means of this carries out data interpolation.

By means of this, the waveform data of the start address and the end address of the repeating portion are brought into agreement, therefore, by means of the repetition of looping, the interpolated values can precisely carry out looping processing, and an advantage is gained in that waveform distortion does not occur. It is possible to use the start address waveform data of the repeating portion as the end address waveform data in the case in which the end address includes a fraction.

BRIEF DESCRIPTION OF THE DRAWINGS

FIGS. 3(*a*) and 3(*b*) are waveform diagrams for the purpose of explaining the operation of the same preferred embodiment.

FIGS. 7(*a*) and 7(*b*) are waveform diagrams for the purpose of explaining the operation of the same preferred embodiment.

FIGS. 9(*a*) through 9(*i*) and 10(*a*) through 10(*k*) are timing charts for the purpose of explaining the operation of the same preferred embodiment.

FIGS. 15(*a*) through 15(*f*) are timing charts showing the timing of a clock signal in the same preferred embodiment.

FIG. 21 is a waveform diagram for the purpose of explaining the initial portion and the repeating portion of a tone source waveform.

FIGS. 22(*a*) through 22(*g*) are waveform diagrams for the purpose of explaining the tone generation principle of a pitch-non-synchronous method.

DETAILED DESCRIPTION OF THE PREFERRED EMBODIMENTS

Hereinafter, the preferred embodiments of the present invention will be explained with reference to the diagrams.

First Preferred Embodiment: A Recording Apparatus for Tone-Source Waveforms

Figure 1:
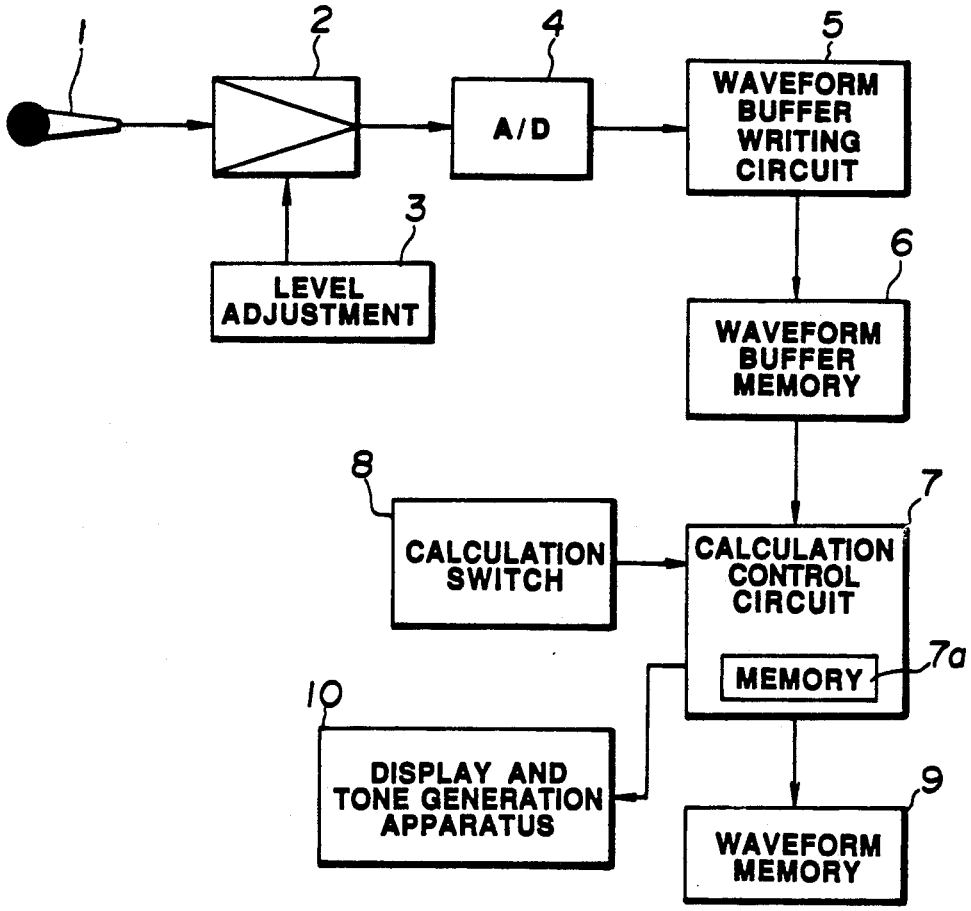
FIG. 1 is a block diagram showing the composition of the first preferred embodiment of the present invention.

FIG. 1 is a block diagram showing the construction of a recording apparatus for tone-source waveforms which is applied to a recording method for tone-source waveforms according to the first preferred embodiment of the present invention. In the diagram, numeral 1 indicates a microphone, which is for the purpose of picking up the tones of an acoustic musical instrument, numeral 2 designates an amplifier which amplifies the output of microphone 1, numeral 3 indicates a level regulator (manual), which regulates the amplification level of amplifier 2, numeral 4 designates an A/D converter, which samples the output of amplifier 2 and converts it to digital data, numeral 5 indicates a waveform buffer write circuit, which writes the output data of A/D converter 4 to waveform buffer memory 6. Numeral 7 indicates an operation control circuit; it has temporary storage memory 7*a* within it. This operation control circuit 7 reads the data within waveform buffer memory 6 in response to a directive from operation directive switch 8, and sends the read-out data to the display and tone-generation apparatus 10, where they are either displayed or a tone is generated. Furthermore, with respect to the sampling data within waveform buffer memory 6, the initial address of the initial portion, the final address of the initial portion, the initial address of the repeating portion, and the final address of the repeating portion are determined, the waveform data within waveform buffer memory 6 are read in accordance with the determined addresses, and they are written to waveform memory 9. This waveform memory 9 is inserted into a regeneration apparatus, the data of the inserted waveform memory 9 are read, and tone generation is carried out in the regeneration apparatus.

Next, the operation of the recording apparatus for tone source waveforms mentioned above will be explained with reference to FIGS. 2–5.

Figure 2:
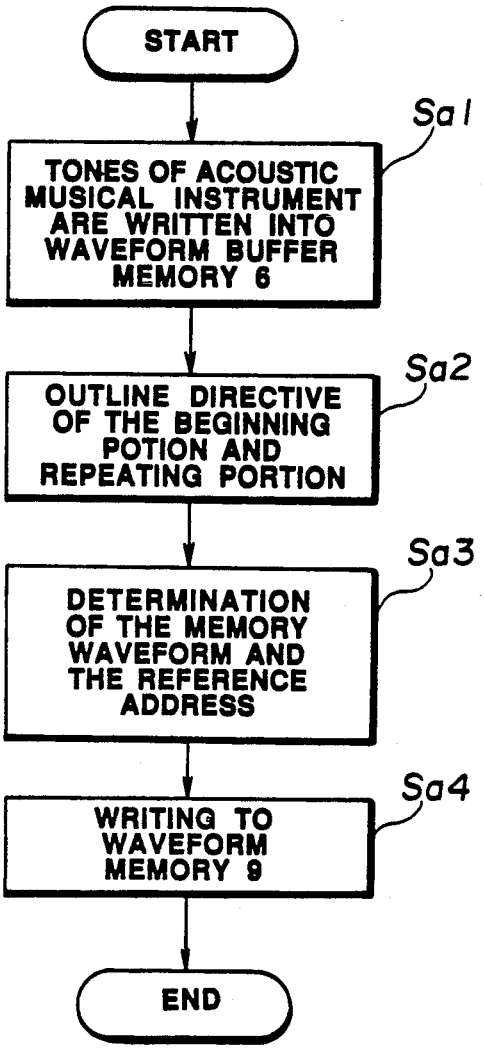
FIG. 2 is a flowchart showing an outline of the operation of the same preferred embodiment.

First, as shown in process Sa1 of FIG. 2, a tone of an acoustic musical instrument is converted to an electric signal by means of microphone 1, this is then converted to digital data by means of A/D converter 4, and these digital data are then written to waveform buffer memory 6 through the medium of waveform buffer write circuit 5. Next, the data within waveform buffer memory 6 are read out, they are converted to analog signals in operation control circuit 7, displayed in display and tone generation apparatus 10, and the initial portion and the repeating portion are manually approximately indicated while looking at the display. FIGS. 3(*a*) and 3(*b*) show an example of the indicated initial portion and repeating portion.

Next, the memory waveform addresses and reference addresses used for the writing and reading of waveform memory 9 are determined by operation control circuit 7 (process Sa3). This process Sa3 is discussed in detail hereinafter. Next, the initial portion and repeating portion of the sampling data within waveform buffer memory 6 are read out, and the read-out data are written to waveform memory 9 based on the waveform memory address which was determined in process Sa3 (process Sa4).

Next, the memory waveform address and reference address determination process will be discussed in detail with reference to FIGS. 3 and 4. First, in step Sb1 of FIG. 4, the sampling data of the initial portion within waveform buffer memory 6 are displayed in display and tone generation mechanism 10. The operator looks at this display and indicates the attack end sample AES. A sampling point in the vicinity of the 0 level of the final part of the initial portion (see FIG. 3(*a*)) can be chosen as this attack end sample AES. This determination is carried out by moving, for example by means of a mouse, an arrow cursor of a display screen to this point and then turning on the switch of the mouse. When this indication has been carried out, the attack end sample address AESA6 ("6" refers to this being an address in waveform memory 6) is used as the address of waveform buffer memory 6 at which the sampling data of the indicated point are stored, and this address is stored in temporary storage memory 7*a*.

Next, in step Sb2, a sampling point (hereinafter called scan start sample SSS; see FIG. 3(*b*)) which is located D points before the initial sampling point FP of the repeating portion (see FIG. 3(*b*)) is indicated. When this indication is carried out, the address SSSA6 of the indicated scan start sample SSS is stored in temporary storage memory 7*a*. Next, in step Sb3, the sampling data of the repeating portion are checked in order (scan search) while oversampling in the usual direction (the direction in which the addresses grow larger) from the above-mentioned address SSSA6, and in step Sb4, a decision is made as to whether sampling data or oversampling data which are in agreement with the attack end sample data AESD (the value of the attack end sample AES) exist or not. Here, what is meant by oversampling is the interpolation between sampling data and the next sampling data, carried out for example using a commonly known FIR filter. Furthermore, the technique of interpolating between sampling data using an FIR filter is disclosed in detail in Japanese Patent Application, Laid-open No. 63-168695, title of the invention "Musical Tone Signal Generating Apparatus."

Next, in the case in which, even if the fixed number of data previously determined have been checked, the result of the judgement of step Sb4 is "No," a display to the effect of "error end" is carried out. On the other hand, in the case in which the result of the judgement is "Yes," step Sb5 is proceeded to. Here, the point of the repeating portion which is in agreement with attack end sample data AESD is called the loop-in point LIP (see FIG. 3).

In this specification, the word "sample" means a point which has sampling data; its address (an address of waveform buffer memory 6) is an integer. In contrast, the word "point" means, in names of specific points, a point between sampling points; its address contains fractions.

In step Sb5, the final part of the initial portion and the initial part of the repeating portion are displayed on the same time axis, and at the same time, the positions of attack end sample AES and the loop-in point LIP are displayed. Next, in step Sb6, a judgement is made by eye as to whether the end of the initial portion and the beginning of the repeating portion are smoothly connected or not. Then, in the case in which the result of this judgement is "No," step Sb7 is proceeded to, and the point detected in step Sb4 (the point of agreement) is displayed again as scan start sample SSS. By means of this, the scan start sample address SSSA6 which was written to memory 7*a* in step Sb2 is reloaded. Next, step Sb3 is returned to, and after this, the same type of processing as above is carried out again. In step Sb7, the reloading of scan start sample address SSSA6 avoids, in spite of the existence, for example, of a suitable loop-in point LIP, the undesirable usage of the point of agreement before this as a loop point. In the case of the waveform shown in FIG. 3(*b*), there is no problem with the usage of the beginning point of agreement as loop-in point LIP; however, during the time when the waveform changes in a complicated manner in the initial part of the repeating portion and like times, as there are a number of points of agreement, it is necessary to confirm whether a detected point of agreement which is appropriate for use as loop-in point LIP exists or not. Steps Sb5 and Sb7 serve the purpose of this confirmation. Then, in step Sb7, in the case in which reloading has occurred, the loop-in point LIP is decided from the points of agreement detected after this.

On the other hand, in the case in which the result of the judgement of step Sb6 is "Yes," step Sb8 is proceeded to. In step Sb8, the address of the loop-in point LIP which was detected by means of the above processes, in other words, the loop-in point address LIPA6 is stored in temporary storage memory 7*a*. Here, in the case in which the loop-in point LIP is in agreement with the sampling point, the address of memory 6 at which the sampling data are stored is stored in stored in temporary storage memory 7*a*; however, in the case in which it is not in agreement, the address will contain a fractional value.

Next, when step Sb9 is proceeded to, the final part of the repeating portion is displayed. The operator looks at this display and indicates the loop end sample LES. In the case of this indication, as in the case of the attack end sample AES mentioned above, a point in the vicinity of the 0 level of the final part of the repeating portion is indicated. Next, when step Sb10 is proceeded to, the scan start sample SSS, which was indicated in step Sb2 mentioned above, is reindicated. When this indication is carried out, the address SSSA6 of waveform buffer memory 6 at which the sampling data of the indicated point SSS are stored is stored in temporary storage memory 7*a*.

Next, when step Sb11 is proceeded to, the sampling data of the repeating portion are checked in order (scan search) while oversampling from scan start sample SSS in the usual direction; in step Sb12, a judgement is made as to whether sampling data or oversampling data which are in agreement with loop end sample data LESD exist or not.

Next, in the case in which, even if the fixed number of data previously determined have been checked, the result of the judgement of step Sb12 is "No," a display to the effect of "error end" is carried out. On the other hand, in the case in which the result of the judgement of step Sb12 is "Yes," step Sb13 is proceeded to. Here, the point of the repeating portion which is in agreement with loop end sample LES is called the loop start point LSP (see FIG. 3). In step Sb13, the final part of the repeating portion and the initial part of the repeating portion are displayed on the same time axis in close connection, and at the same time, the positions of loop end sample LES and the loop start point LSP are displayed. Next, in step Sb14, a judgement is made by eye as to whether the end of the initial portion and the beginning of the repeating portion are smoothly connected or not. Then, in the case in which the result of this judgement is "No," step Sb15 is proceeded to, and the point detected this time is displayed again as scan start sample SSS. By means of this, the scan start sample address SSSA6 which was written to memory 7*a* in step Sb10 is reloaded. Next, step Sb11 is returned to, and after this, the same type of processing as above is carried out again.

On the other hand, in the case in which the result of the judgement of step Sb14 is "Yes," step Sb16 is proceeded to. In step Sb16, the address of the loop start point LSP, in other words, the loop start point address LSPA6, is stored in temporary storage memory 7*a*. This loop start point address LSPA6 generally includes values to the right of the decimal point. Next, when step Sb17 is proceeded to, based on attack end sample AES, loop-in point LIP, loop end sample LES, and loop start point LSP, which were determined in the course of the above procedures, the sampling data of the initial portion and repeating portion within the waveform buffer memory are read out, and a test tone generation is carried out according to the same method used in the data regeneration discussed hereinafter. Then, in step Sb18 a judgement is made as to whether the result of this tone generation test is "OK" or not; in the case in which the result of the judgement is "No," step Sb1 is returned to and the procedure redone from the beginning. Furthermore, in the case in which the result of the judgement is "Yes," step Sb19 is proceeded to. The processes of steps Sb13 and Sb15 are confirmation procedures identical to those of the steps Sb5 and 7 discussed above.

In step Sb19, the following addresses are calculated and written to temporary storage memory 7*a*.

*Attack first sample address AFSA6

An address of waveform buffer memory 6 at which the sampling data of the beginning of the initial portion are stored.

*Attack last sample address ALSA6

An address greater by 3 than the attack end sample address AESA (ALSA=AESA+3).

*Loop first sample address LFSA6

The greatest address of the addresses which are smaller than the loop start point address LSPA by 2.5 or more.

*Loop last sample address LLSA6

An address greater by 3 than the loop end sample address LESA (LLSA=LESA+3).

These addresses are all necessary when computing the interpolated data. In the case in which interpolation processing is not necessary, supplementary addresses are not created.

Next, when step Sb20 is proceeded to, first, the above-mentioned addresses AFSA6, ALSA6, LFSA6, and LLSA6 are converted to addresses AFSA, ALSA, LFSA, and LLSA of waveform memory 9 respectively. Then, the sampling data between addresses AFSA6 and ALSA6 of the sampling data of the initial portion within waveform buffer memory 6 and the sampling data between addresses LFSA6 and LLSA6 of the sampling data of the repeating portion are read out, and are then written to waveform memory 9 in accordance with the above-mentioned addresses AFSA, ALSA, LFSA, and LLSA.

Figures 5A, 5B, 5C:
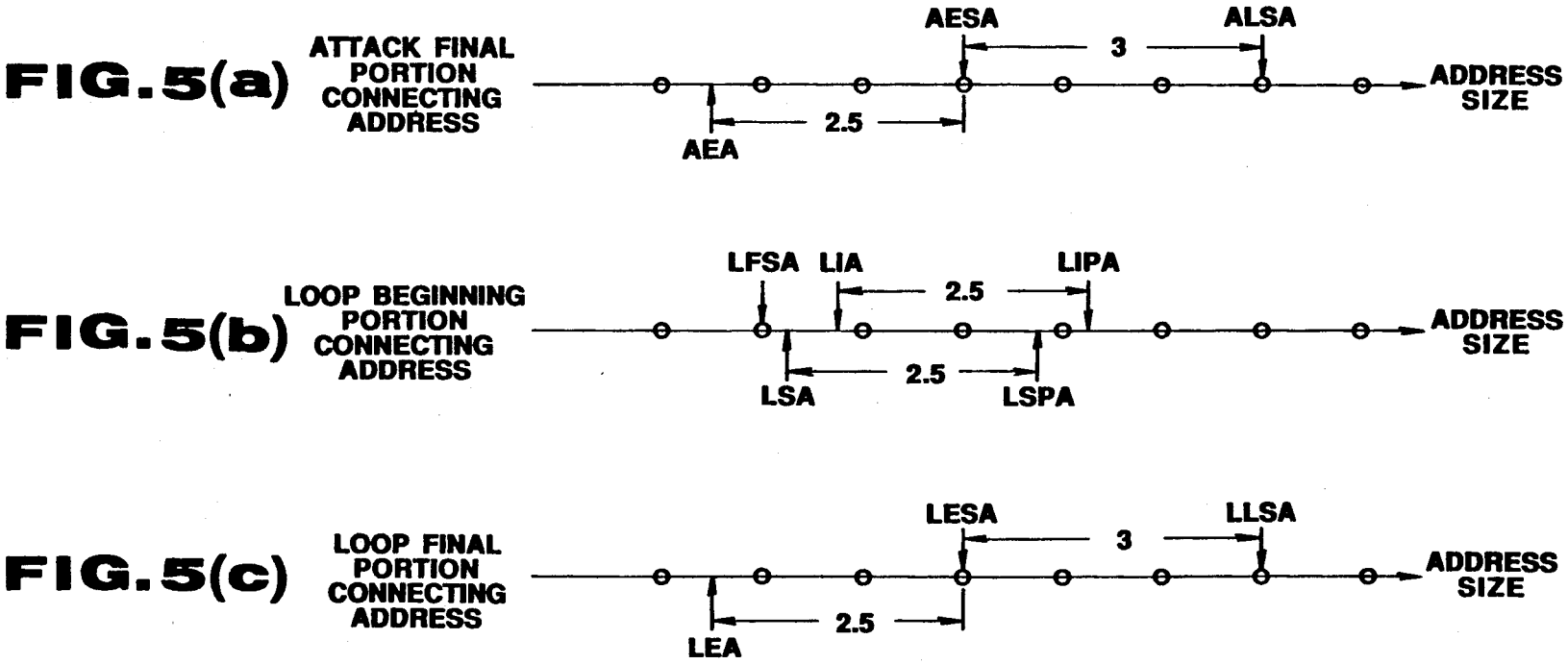
FIGS. 5(*a*) and 7(*b*) are conceptual diagrams for the purpose of explaining each address in the same preferred embodiment.

Next, when step Sb21 is proceeded to, the following reference addresses are calculated (see FIG. 5). These reference addresses are used with the addresses calculated in step Sb19 at the time of data regeneration.

*Attack end address AEA (see FIG. 5(*a*))

An address smaller than the attack end sample address AESA by 2.5 (AEA=AESA−2.5).

*Loop-in address LIA (see FIG. 5(*b*))

An address smaller than the loop-in point address LIPA by 2.5 (LIA=LIPA−2.5).

*Loop start address LSA (see FIG. 5(*b*))

An address smaller than the loop start point address LSPA by 2.5 (LSA=LSPA−2.5).

*Loop end address LEA (see FIG. 5(*c*))

An address smaller than the loop end sample address LESA by 2.5 (LEA=LESA−2.5).

The above is the recording apparatus tone source waveforms according to the first preferred embodiment of the present invention.

Second Preferred Embodiment: A Recording Apparatus for Tone-Source Waveforms

Next, a recording apparatus for tone-source waveforms according to a second preferred embodiment of the present invention will be explained. The overall construction of this apparatus according to the second preferred embodiment is identical to that of the first preferred embodiment (see FIG. 1). The difference from the first preferred embodiment lies in the storage waveform address and reference address determination process Sa3 in FIG. 2.

Figure 6:
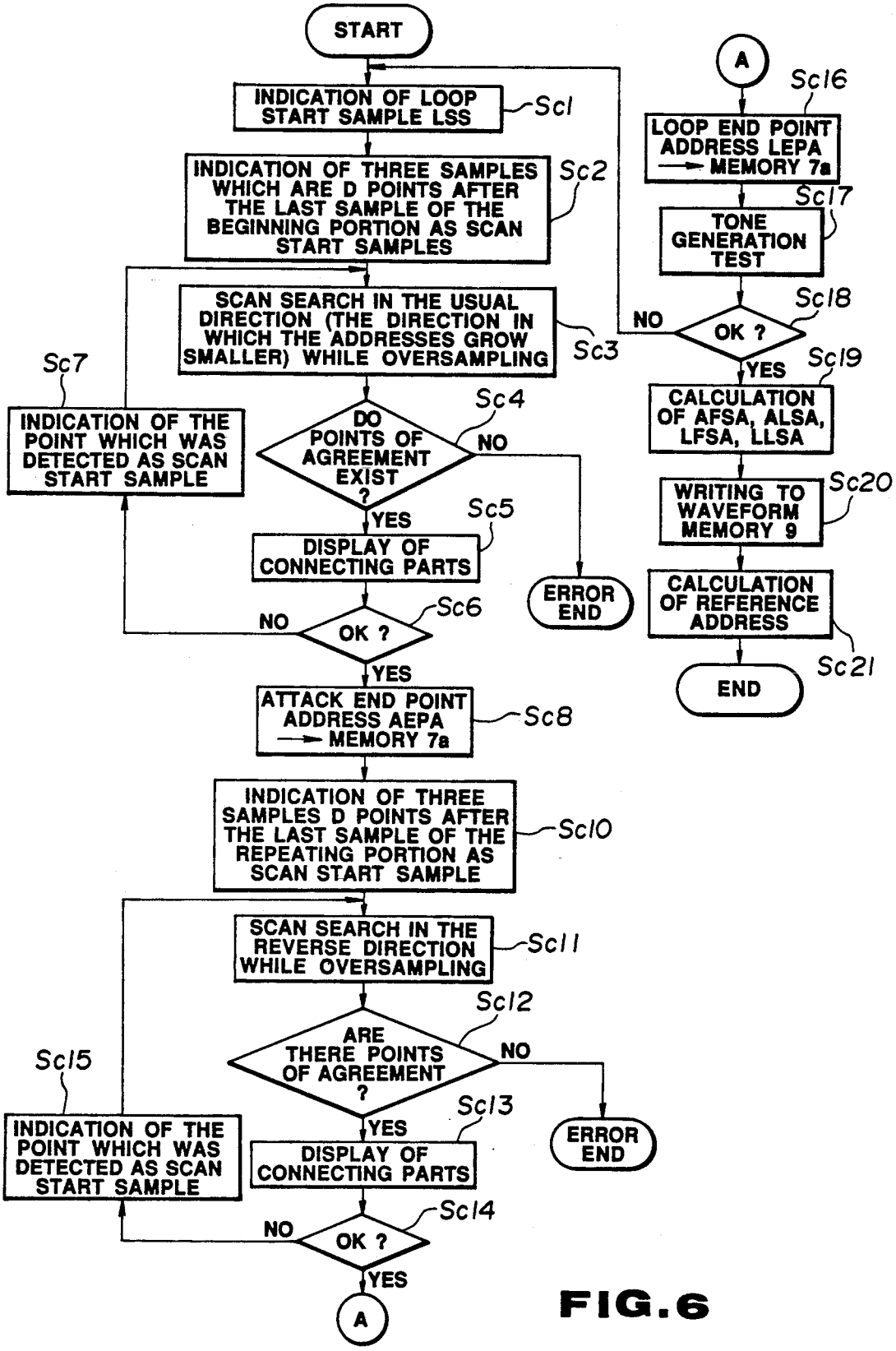
FIG. 6 is a flowchart showing the operation of the second preferred embodiment of the present invention.

In FIG. 6, a flowchart of the process Sa3 in the second preferred embodiment is shown. The points of difference between the process shown in this diagram and the process shown in FIG. 4 are as follows. The process shown in FIG. 4 first determines the attack end sample AES of FIG. 3 and seeks a loop-in point LIP which is in agreement with this attack end sample, then determines the loop end sample LES and seeks a loop start point LSP which is in agreement with this loop end sample LES.

In contrast, the process shown in FIG. 6, as shown in FIG. 7, first determines the loop start sample LSS and next seeks an attack end point AEP which is in agreement with this loop start sample LSS (steps Sc1–Sc8), then seeks a loop end point LEP which is in agreement with this loop start sample LSS (steps Sc10–Sc16).

Figure 4:
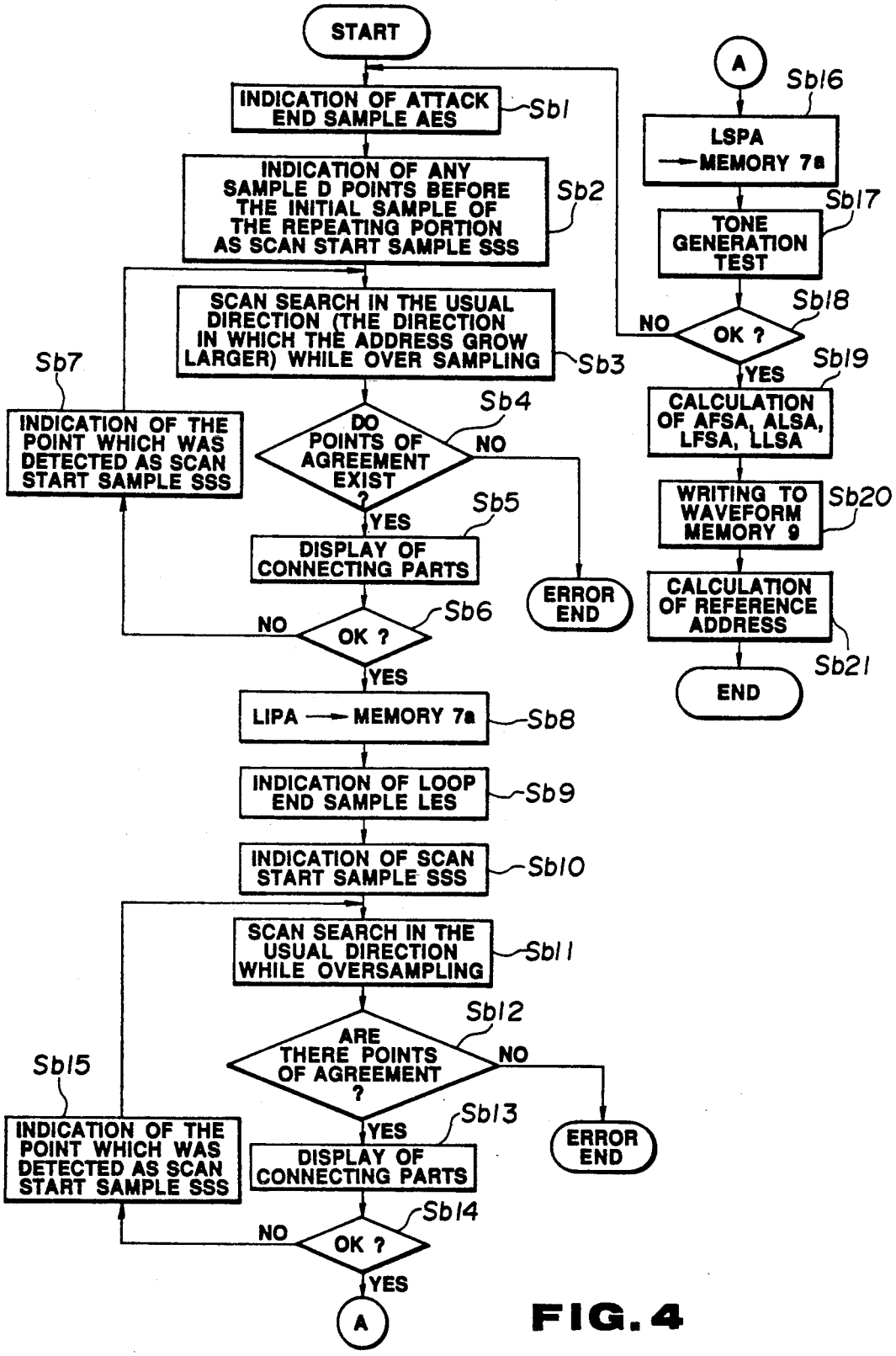
FIG. 4 is a flowchart showing the processing to determine the stored waveform address and reference address in the same preferred embodiment.

As the processes of the steps in FIG. 6 are generally identical to the processes of the steps in FIG. 4, an explanation of them will be omitted.

Figure 8:
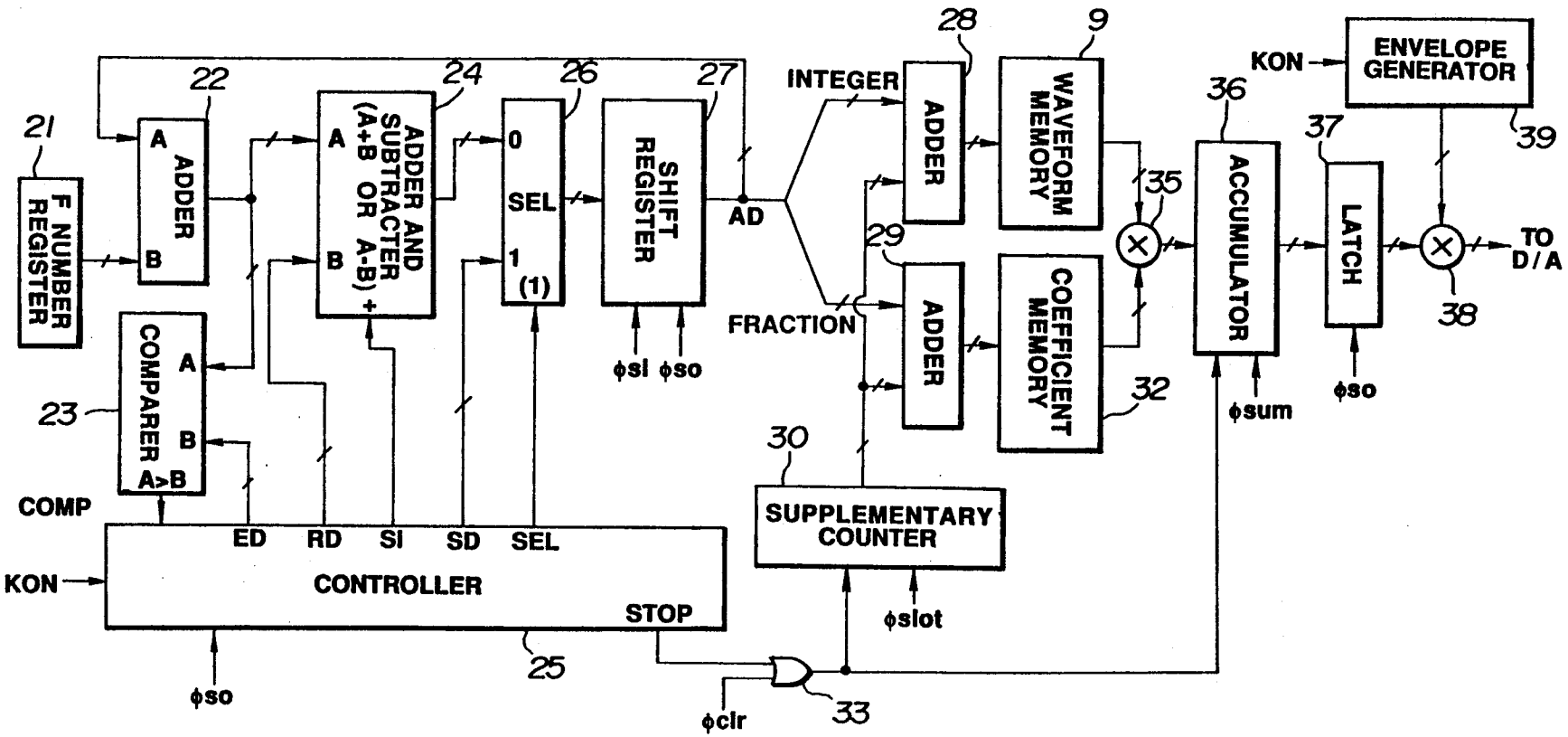
FIG. 8 is a block diagram showing the composition of the third preferred embodiment of the present invention.

Third Preferred Embodiment: A Regeneration Apparatus for Tone-Source Waveforms FIG. 8 is a block diagram showing the construction of a regeneration apparatus for tone-source waveforms to which a regeneration method for tone-source waveforms in accordance with the present invention has been applied. In the diagram, numeral 21 represents an F number (frequency number) register; when a key on the keyboard (not shown) is depressed, an F number corresponding to the depressed key is written. Here, the F number comprises numerical-value data including fractional portion which have been determined in advance to correspond to each key of the keyboard; the F numbers increase the higher the key becomes. Numeral 22 indicates an adding circuit, numeral 23 indicates a comparing circuit, and numeral 24 indicates an adding and subtracting circuit. This adding and subtracting circuit 24 functions as an adding circuit when supplied with a "1" signal as a control signal from controller 25 and as a subtracting circuit when supplied with a "0" signal. Numeral 26 indicates a selector and numeral 27 indicates a one-stage shift register. This shift register 27 reads the output of selector 26 at the beginning of a clock pulse $\phi$-s0, and outputs the read-out data at the beginning of a clock pulse $\phi$-s1. The output of this shift register 27 is outputted as address data AD and supplied to adding circuit 22; in addition, the integer potion of this is supplied to adding circuit 28, and furthermore, the fractional portion is supplied to adding circuit 29.

Adding circuit 28 adds the integer portion of address register AD and the count output of supplementary counter 30, and then outputs the result of this addition to waveform memory 9 as an address. Adding circuit 29 adds the fractional portion of address register AD and the count output of supplementary counter 30, and outputs the result of this addition to coefficient memory 32 as an address. Waveform memory 9 is the memory into which the initial and repeating portions of the waveform are written by means of the circuits of FIG. 1 mentioned above. Coefficient memory 32 is the memory into which the filter coefficients of the FIR filters are written. In this preferred embodiment, by means of a series of six FIR filters, the interval between sampling data and sampling data is interpolated in accordance with the value of the fractional part of address register AD, which was outputted from shift register 27.

Figure 11:
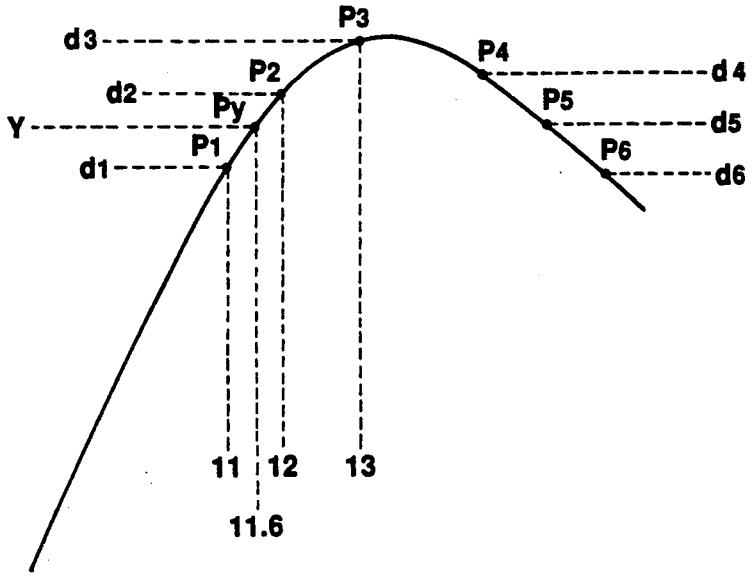
FIG. 11 is for the purpose of explaining the data interpolation.

In other words, now, for example as shown in FIG. 11, in the case in which the data of the sampling points P1–P6 (oscillation range values) are made d1–d6, the addresses of waveform memory 9 at which data d1–d6 are stored are specified as "11"–"16," and address data AD, which are outputted from shift register 27, are "11.6", the interpolation data Y corresponding to address "11.6" are calculated by FIR filter from the six data d1–d6. In addition, the coefficient used at the time of the filter calculation has been previously stored in coefficient memory 32 in correspondence with the fractional part of address register AD.

Supplementary counter 30 is cleared by means of the clock pulse phi-clr supplied through the medium of or-gate 33, and up-counts a clock pulse phi-slot. Numeral 35 indicates a multiplying circuit; it multiplies the output data of waveform memory 9 and the output data of coefficient memory 32, and outputs the result of this multiplication to accumulator 36. Accumulator 36 accumulates the output data of multiplying circuit 35 at the beginning of clock pulse phi-sum, and is furthermore cleared by means of the clock pulse phi-clr supplied through the medium of or-gate 33. Latch 37 latches the output data of accumulator 36 at the beginning of clock pulse phi-so and outputs the latched data to multiplying circuit 38. Numeral 39 indicates an envelope generator; it receives a key-on signal KON which begins when one of the keys of the keyboard is depressed and ends when the key is released, generates envelope data which determine the envelope of the musical signal, and outputs them to multiplying circuit 38. Multiplying circuit 38 multiplies the output data of latch 37 and the envelope data mentioned above and outputs the result of this multiplication. The output data of this multiplying circuit 38 are converted to an analog signal by means of a D/A converter (not shown in the diagram), supplied to a sound system, and emitted as a musical tone. Controller 25 controls each part of the apparatus of FIG. 8; the addresses and attack first sample address AFSA shown in FIG. 5 are stored within it. A detailed discussion is given below.

Next, the operation of the above-mentioned preferred embodiment will be explained with reference to the timing chart shown in FIG. 10.

First, shift register 27 is clear in its initial state. Furthermore, a "1" signal is outputted from controller 25 as a control signal STOP; by means of this, a "1" signal is outputted from or-gate 33, and supplementary counter 30 and accumulator 36 are both placed in a cleared state.

In this state, when a key of the keyboard (not shown) is depressed, an F number corresponding to the depressed key is written to F-number register 21, and at the same time the key-on signal KON is supplied to controller 25 and envelope generator 39. When the key-on signal KON is supplied to controller 25, controller 25 receives the same signal KON, and outputs "0" as data RD and "1" as control signal SI to adding and subtracting circuit 24; furthermore, it outputs attack first sample address AFSA as data SD, and a "1" signal as control signal SEL, to selector 26. When the control signal SEL of "1" is supplied to selector 26, the same selector 26 supplies the above-mentioned attack first sample address AFSA to the input end of shift register 27.

Next, at the time t1 shown in FIG. 9, when the clock pulse phi-s0 shown by (a) in the same diagram begins, the attack first sample address AFSA which is outputted from selector 26 is read into shift register 27; then, when the clock pulse phi-s1 ((b) in FIG. 9) begins, the same address AFSA is outputted from shift register 27 as address data AD. Next, the integer part of this is supplied to adding circuit 28 and the fractional part of this (in this case "0") is supplied to adding circuit 29. At this time, the output of supplementary counter 30 is "0"; accordingly, the integer part of address AFSA is outputted from adding circuit 28 and supplied to waveform memory 9. By means of this, the attack first sample data AFSD are read out of waveform memory 9 and supplied to multiplying circuit 35. Furthermore, data "0" are outputted from adding circuit 29 and supplied to coefficient memory 32. In this case, the data "1" are outputted from coefficient memory 32 and supplied to multiplying circuit 35. Multiplying circuit 35 multiplies data AFSD and data "1" and outputs the result of this multiplication, in other words, outputs data AFSD to accumulator 36.

Next, the clock pulse phi-clr begins, but at this time the control signal STOP is a "1" signal; accordingly, there is no change in circuit operations. Next, at the time of the cessation of clock pulse phi-clr, control signal SEL and control signal STOP both end and become "0" signals ((g) and (h) in FIG. 9). By means of this, the output data of the adding and subtracting circuit 24 are afterward outputted from selector 26, and furthermore, clock pulse phi-clr is placed in a state in which it is outputted from or-gate 33.

Next, when the clock pulse phi-sum ((e) in FIG. 9) begins, the data AFSD outputted from multiplying circuit 35 are read into accumulator 36 and outputted to latch 37. Next, when the clock pulse phi-slot ((d) in FIG. 9) begins, the count of supplementary counter 30 is increased, the count output of this becomes "1," and this data "1" is supplied to adding circuits 28 and 29. By means of this,

AFSA+1 is outputted from adding circuit 28 and supplied to waveform memory 9, the data of the next sampling point after attack first sample AFS are read out from waveform memory 9 and supplied to multiplying circuit 35. On the other hand, data "1" are outputted from adding circuit 29 and supplied to coefficient memory 32. Coefficient memory 32 outputs data "1" when "0" is being supplied from adding circuit 29 as described above; however, it outputs data "0" when integer data are being supplied from adding circuit 29. Accordingly, in this case, data "0" are outputted from coefficient memory 32, and by means of this, data "0" are outputted from multiplying circuit 35.

Next, when clock pulse phi-sum begins, the output data "0" of multiplying circuit 36 are accumulated with the data within accumulator 36 (in this case, AFSD), and as a result, data AFSD are outputted from accumulator 36. Next, when clock pulse phi-slot begins again, the count output of supplementary counter 30 becomes "2," and as a result,

AFSA+2 is outputted from adding circuit 28 and "2" is outputted from adding circuit 29. By means of this, "0" is again outputted from multiplying circuit 35, and this is accumulated in accumulator 36 when the next clock pulse phi-sum begins. Hereinafter, the same kind of process is repeated until the output of supplementary counter 30 becomes "5."

Next, when clock pulse phi-s0 begins at the time t2 shown in FIG. 9, the output data (in this case, AFSD) of accumulator 36 are read into latch 37. Then, these read-in data are multiplied with the envelope data outputted from envelope generator 39 in multiplying circuit 38, and the result of this multiplication is outputted to a D/A converter.

On the other hand, just before the beginning of the above-described clock pulse phi-s0, the output data of shift register 27 are attack first sample address AFSA. This attack first sample address AFSA is supplied to adding circuit 22; here, an F number is added, and the result of this addition, "AFSA+F," is supplied to adding and subtracting circuit 24. At this time, a "1" signal is outputted from controller 25 as control signal SI, and accordingly, this adding and subtracting circuit 24 functions as an adding circuit. Furthermore, at this time, "0" is outputted from controller 25 as data RD. As a result, the output data of adding and subtracting circuit 24 become "AFSA+F," and these data "AFSA+F" are supplied to the input end of shift register 27 through the medium of selector 26. Accordingly, at this time t2, when clock pulse phi-s0 begins, these data "AFSA+F" are read into shift register 27.

Next, when clock pulse phi-s0 begins, data "AFSA+F" are outputted from shift register 27, and the integer part of this is supplied to adding circuit 28, while the fractional part is supplied to adding circuit 29. Here, the F number is a fractional number. Accordingly, in this case, the integer part becomes data AFSA, while the fractional part becomes F. Next, when clock pulse phi-clr begins, supplementary counter 30 and accumulator 36 are cleared. At this time, the output of adding circuit 28 becomes AFSA, and accordingly, attack first sample data AFSD are outputted from waveform memory 9. On the other hand, at this time, the output of adding circuit 28 becomes F, and this data F (fraction) is supplied to coefficient memory 32. The six filter coefficients k0(x)–k5(x) which correspond to the fractions x supplied from adding circuit 29 are stored in coefficient memory 32. For example, if the fractional part of address data AD outputted from shift register 27 has three bits, seven groups of filter coefficients k0(x)–k5(x) corresponding to the seven fractions excepting "0, 0, 0" are stored. Accordingly, when data F are supplied from adding circuit 29, the first filter coefficient k0(F) from among the six filter coefficients corresponding to the same data F is read out and outputted to multiplying circuit 35. As a result, $$k0(F)\cdot D(AFSA)$$

is outputted from multiplying circuit 35 and read into accumulator 36 at the beginning of the next clock pulse phi-sum. Here, D(X) shows the data stored at the memory position of address X of waveform memory 9. D(AFSA) shows the data at address AFSA, in other words data AFSD.

Next, when clock pulse phi-slot begins, the count output of supplementary counter 30 becomes "1," and the output of adding circuits 28 and 29 becomes $$(AFSA+1) \text{ and } 1.F,$$

respectively. By means of this, data D(AFSA+1) at address (AFSA+1) are read out of waveform memory 9 and supplied to multiplying circuit 35; furthermore, the second coefficient data k1(F) are read out from coefficient memory 9 and supplied to multiplying circuit 35. By means of this, the data $$k1(F)\cdot D(AFSA+1)$$

are outputted from multiplying circuit 35, and these data are read into accumulator 36 at the beginning of the next clock pulse phi-sum.

After this, the same type of process is continued until the output of supplementary counter 30 becomes "5;" by means of this, the output of accumulator 36 becomes $$k0(F)\cdot D(AFSA)+k1(F)\cdot D(AFSA+1)+\ldots +k5(F)\cdot D(AFSA+5) \quad (1)$$

In other words, the output becomes data interpolated by means of FIR filters in correspondence with the fractional portion F of address data "AFSA+F." Next, when clock pulse phi-s0 begins again, the data of the first formula discussed above are read into latch 37, these read-in data are multiplied with the envelope data in multiplying circuit 38, and outputted to a D/A converter.

Furthermore, just before the beginning of clock pulse phi-s0 discussed above, the output of selector 26 becomes "AFSA+2F." As a result, when clock pulse phi-s0 begins, "AFSA+2F" is read into shift register 27 and outputted from shift register 27 at the beginning of the next clock pulse phi-s1. Here, if data 2F are fractional numbers, a process identical to that discussed above is carried out, and at the beginning of the next clock pulse phi-s0 the data $$k0(2F)\cdot D(AFSA)+k1(2F)\cdot D(AFSA+1)+\ldots +k5(2F)\cdot D(AFSA+5) \quad (2)$$

are read into latch 37.

Next, data "AFSA+3F" are outputted from shift register 27, and the fractional portion of these data is designated G. In other words, $$AFSA+3F=(AFSA+1)+G.$$

In this case, at the beginning of the next clock pulse phi-s0, the data $$k0(G)\cdot D(AFSA+1)+k1(G)\cdot D(AFSA+2)+\ldots +k5(G)\cdot D(AFSA+6) \quad (3)$$

are read into latch 37 and outputted to multiplying circuit 38.

In this way, the data of waveform memory 9 are successively read out based on the output data of shift register 27, these read-out data are interpolated, after interpolation the data are outputted from latch 37 according to the timing of clock pulse phi-s0, multiplied with the envelope data in multiplying circuit 38, and outputted to an A/D converter. Then, the output of this A/D converter is supplied to the sound system, and the musical tone of the initial portion is generated.

Figures 10A, 10B, 10C, 10D, 10E, 10F, 10G, 10H, 10I, 10J, 10K:
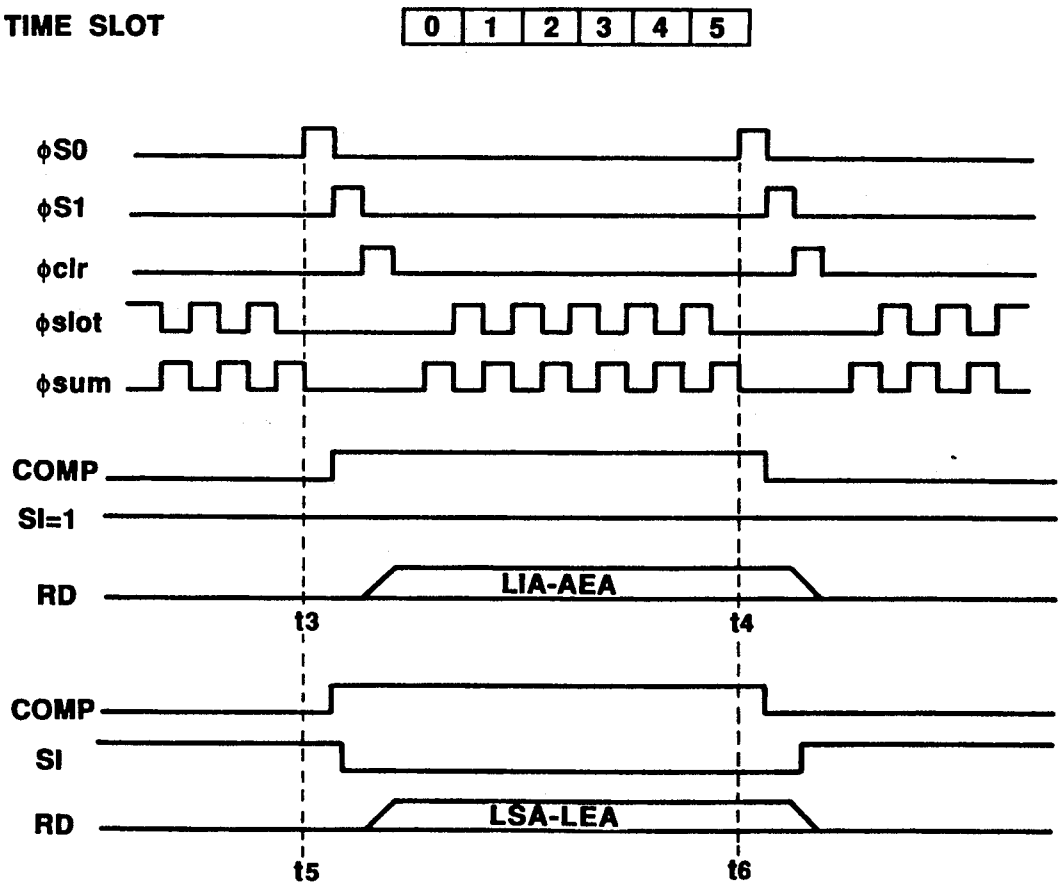

Next, when the generation of the musical tone of the initial portion is completed and the output data of adding circuit 22 exceed attack end address AEA, a "1" signal is outputted from comparing circuit 23 as signal COMP (see FIG. 10(*f*)) and supplied to controller 25. Controller 25 receives this "1" signal and outputs "LIA-AEA" (loop-in address-attack end address) as data RD (see FIG. 10(*h*)). By means of this, address LIA is outputted from adding and subtracting circuit 24 and supplied to the input end of shift register 27 through the medium of selector 26. Then, this address LIA is read into shift register 27 at the beginning of the next clock pulse phi-s0 (time t4 in FIG. 10), and then outputted to adding circuits 28 and 29 as well as adding circuit 22 at the beginning of clock pulse phi-s1. At this time, controller 25 outputs loop end address LEA as data ED to comparing circuit 23. By means of this, the output signal COMP of comparing circuit 23 becomes "0" (see FIG. 10(*f*)). After this, the generation of the musical tone of the repeating portion is carried out according to the same type of procedure as that of the initial portion discussed above.

Next, when the generation of the musical tone of one cycle of the repeating portion is completed and the output data of adding circuit 22 exceed loop end address LEA, a "1" signal is outputted from comparing circuit 23 as signal COMP (see FIG. 10(*i*) and time t5) and supplied to controller 25. Controller 25 receives this "1" signal and outputs "LSA-LEA" (loop start address-loop end address) as data RD (see FIG. 10(*k*)). By means of this, address LSA is outputted from adding and subtracting circuit 24 and supplied to the input end of shift register 27 through the medium of selector 26. Then, this address LSA is read into shift register 27 at the beginning of the next clock pulse phi-s0 (time t6 in FIG. 10), and then outputted to adding circuits 28 and 29 as well as adding circuit 22 at the beginning of clock pulse phi-s1. By means of this, the output signal COMP of comparing circuit 23 becomes "0" (see FIG. 10(*i*). After this, the generation of the musical tone of the repeating portion is again carried out, and after this, the same type of procedure is repeated. Then, when a key of the key board is released, the envelope data are gradually reduced to 0, and along with this the musical tone is gradually reduced and then stopped.

The preferred embodiment discussed above conducts data interpolation by means of FIR filters; however, it is acceptable to draw a curve through the six points P1–P6 in FIG. 11 and obtain interpolation data from this curve.

Fourth Preferred Embodiment: A Pitch-Non-Synchronous Tone Source

A: Basic Principle of the Preferred Embodiment

Figures 14A, 14B:
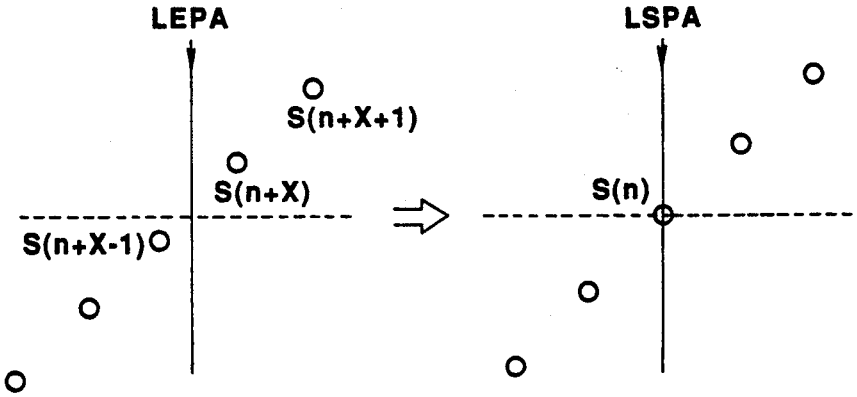
FIGS. 14(*a*) through 14(*c*) are conceptual diagrams showing the positional relationship between the boundary of the repeating portion and the waveform data in the same preferred embodiment.
Figure 14C:
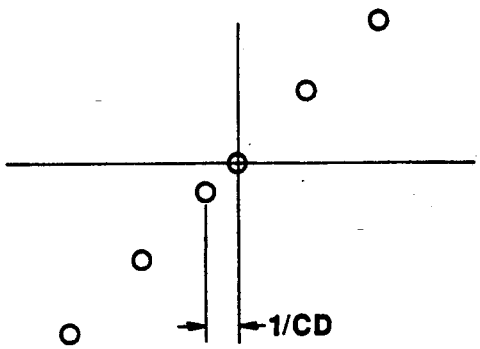

First, the basic principle of the present invention will be explained. First, the address of the looping-initial point in the waveform memory is made loop start point address LSPA, and the address of the looping-final point is made loop end point address LEPA. In the pitch-non-synchronous method, when loop start point address LSPA is brought into agreement with a sampling point, as shown in FIG. 14(*b*), loop end point address LEPA is not in agreement with a sampling point (see FIG. 14(*a*)), as stated above. Moreover, as $S(n+x)$ and $S(n+x+1)$ are not sampled, it is impossible to carry out interpolation in the space between $S(n+x-1)$ and loop end point address LEPA. There, in the present preferred embodiment, using the waveform data of loop start point address LSPA as the waveform data of loop end point address LEPA, the interpolation between $S(n+x-1)$ and loop end point address LEPA can be conducted using $S(n+x-1)$ and $S(n)$. It utilizes the fact that, if there are cyclical waveforms, the waveform data of loop end point address LEPA become equal to the waveform data of loop start point address LSPA.

In this case, the distance between $S(n+x-1)$ and loop end point address LEPA is different from the distance between the usual sampling points, so that the interpolation between $S(n+x-1)$ and loop end point address LEPA corrects the interpolated values.

By means of the carrying out of the above interpolation process, the equality of the interpolated values in the looping process is maintained, and waveform data which are free of aberrations can be obtained.

The above is the basic principle of the preferred embodiment.

B: Composition of the Preferred Embodiment

Figure 12:
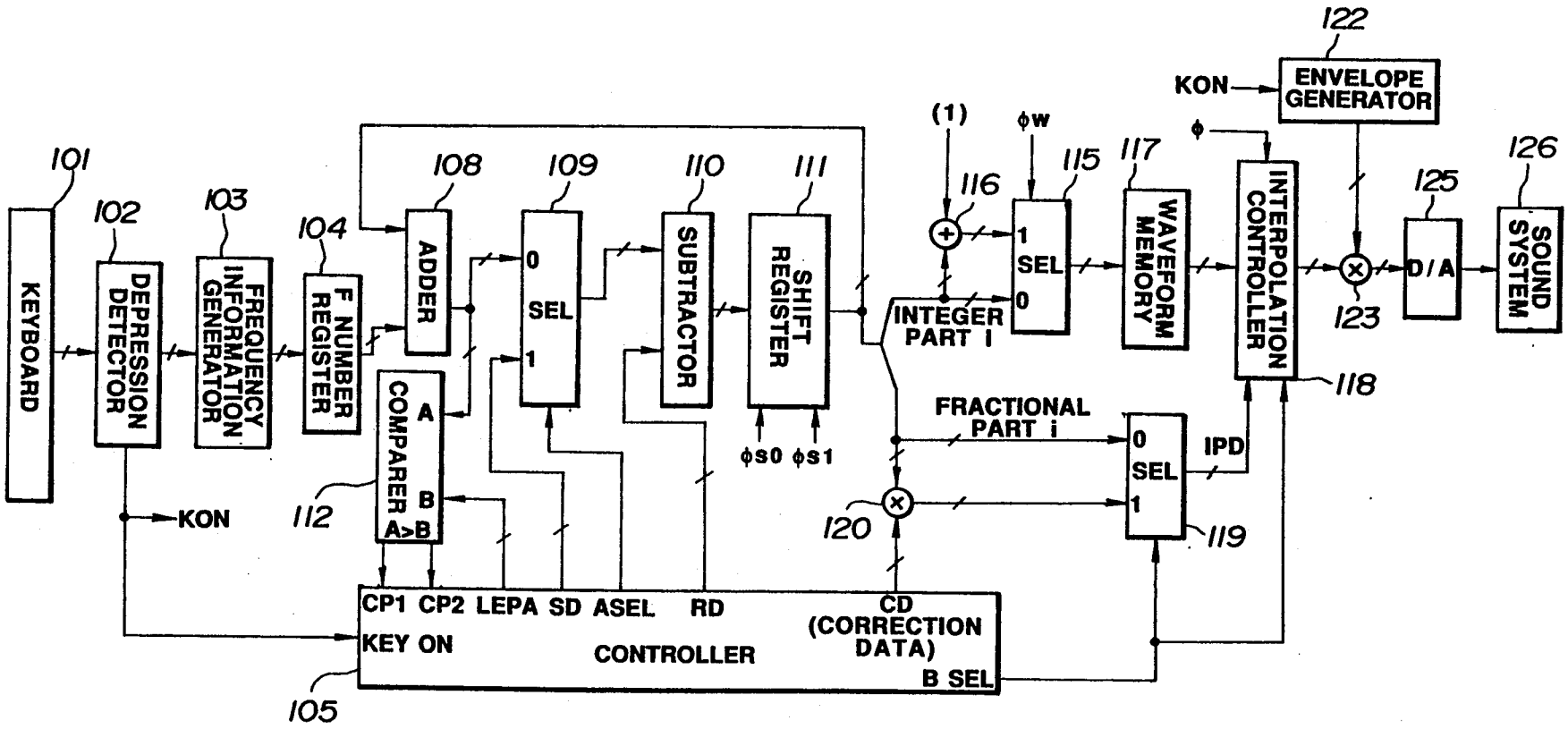
FIG. 12 is a block diagram showing the overall composition of the fourth preferred embodiment of the present invention.

FIG. 12 is a block diagram showing the composition of a preferred embodiment of the present invention. In the diagram, numeral 101 indicates a keyboard comprising a number of keys; the key signal outputted from each key of keyboard 101 is supplied to depression detection mechanism 102. Depression detection mechanism 102 outputs a key code KC showing the key based on the key signal, and when depression is detected, outputs a key-on signal KON. Numeral 103 indicates a frequency information generator; it generates an F number, which is frequency information, in correspondence with key code KC. This F number is inputted into F number register 104.

Next, numeral 105 is a controller, comprising a CPU, a ROM, and an I/O port, which controls each part of the apparatus. When key-on signal KON is supplied, this controller 105 generates a control signal in accordance with fixed timing.

Numeral 108 indicates an adder; the F number outputted by F number register 4 is supplied to one input end thereof, and its output signal is supplied to one input end of selector 109. Selector 109 selects the zeroth input end when signal ASEL outputted by controller 105 is "0", and selects the first input end when this signal is "1." Start data SD are supplied to the first input end of selector 9 from controller 105. Start data SD are the initial read-out address of the waveform data and show the initial address of the initial portion. These start data SD are previously set at differing values depending on tone color and the like. Numeral 110 indicates a subtractor; when controller 105 outputs signal RD, it subtracts signal SD from the output signal of selector 109 and supplies it to shift register 111. Furthermore, when controller 105 is not putting out signal RD, the output signal of selector 109 passes through subtractor 110 without change and is supplied to shift register 111. Shift register 111 is a circuit which conducts shift operations based on clock signals phi-s0 and phi-s1. Clock signals phi-s0 and phi-s1 are signals outputted according to the timing shown in FIG. 15(*e*) and (*f*); shift register 111 takes in the signals supplied at the beginning of clock signal phi-s0 and outputs, at the beginning of clock signal phi-s1, the signals taken in. The output signal of this shift register 111 is supplied to the other input end of adder 108 and added to the F number.

Next, numeral 112 indicates a comparer; loop end point address LEPA, which is outputted by controller 105, is supplied to input end B, and the output signal of adder 108 is supplied to input end A. Then, when $A>B$, signal CP1 (a "1" signal) is outputted, and when $A>\text{int}(B)$, signal CP2 (a "1" signal) is outputted. Here, A and B are the sizes of the signals supplied to input ends A and B respectively and int(B) indicates the integer portion of the signal supplied to input end B. The signals CP1 and CP2 are supplied to controller 105; when signal CP1 is supplied, controller 105 outputs the signal RD discussed above. Signal RD indicates the size of the loop; it is a signal which shows the difference between loop end point address LEPA and loop start point address LSPA.

Next, numeral 116 indicates an adder, which adds "1" to the integer portion of the output signal of shift register 111; the output signal of this adder is supplied to the first input end of selector 115. Furthermore, the integer portion I of the output signal of shift register 111 is directly supplied to the zeroth input end of selector 115. Selector 115 conducts selecting operations in accordance with clock signal phi-w. In this case, clock signal phi-w is outputted in accordance with the timing shown in FIG. 15(*a*); selector 115 selects the first input end when clock signal phi-w is "1" and selects the zeroth input end when clock signal phi-w is "0." The output signal of this selector 115 is supplied to waveform memory 117 as address data, and by means of this, the waveform data stored in waveform memory 117 are accessed by means of positive number portion I and $(I+1)$.

On the other hand, the fractional portion i of the output signal of shift register 111 is supplied to the zeroth input end of selector 119 and one input end of multiplier 120. Correction data CD are supplied to the other input end of multiplier 120 from controller 105. Correction data CD will be discussed hereinafter.

Figure 13:
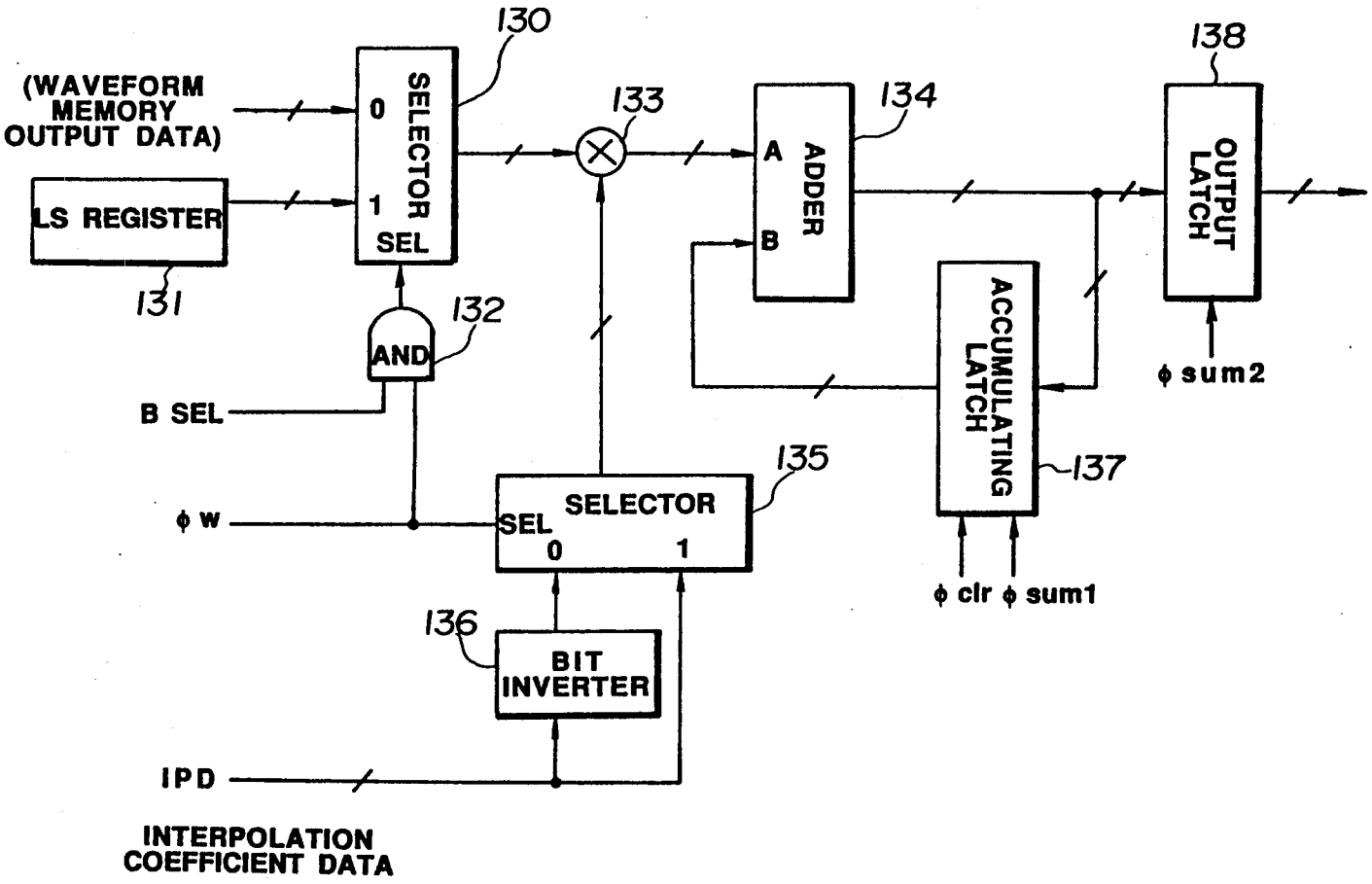
FIG. 13 is a block diagram showing the composition of the interpolation controller in the same preferred embodiment.

Furthermore, the output signal of multiplier 120 is supplied to the first input end of selector 119. Selector 119 carries out selecting operations by means of signal BSEL supplied from controller 105; when signal BSEL is "0," it selects the zeroth input end, and when the signal is "1," it selects the first input end. The output signal of this selector 119 is supplied to interpolation controller 118 as interpolation coefficient data IPD. Interpolation controller 118 carries out interpolation based on interpolation coefficient data IPD, signal BSEL, and waveform data corresponding to integer portion I and (I+1) outputted from waveform memory 117. Here, the construction of interpolation controller 118 is shown in FIG. 13.

In the diagram, numeral 130 represents a selector; waveform data read out from waveform memory 117 are supplied to the zeroth input end, while the output signal of LS register 131 is supplied to the first input end. The waveform data values (hereinafter called the loop start point data LSPD) in loop start point address LSPA are written to LS register 131 when key-on signal KON is generated. Selector 130 selects the first input end when the output signal of and-gate 132 is "1," and selects the zeroth input end when this signal is "0"; and-gate 132 obtains the logical product of signal BSEL and clock signal phi-w. Numeral 133 indicates a multiplier which multiplies the output signal of selector 130 and the output signal of selector 135; its output signal is supplied to one input end of adder 134. Interpolation coefficient data IPD are supplied directly to the first input end of selector 135, and interpolation coefficient data IPD are supplied to the zeroth input end after being bit-inverted by bit inverter 136.

Next, the output signal of adder 134 is supplied to the input end of output latch 138. Output latch 138 latches the output signal of adder 134 when clock signal phi-sum2 (see FIG. 15(*c*)) begins. Furthermore, the input signal of adder 138 is supplied to accumulating latch 137. Accumulating latch 137 latches the output signal of adder 134 when clock signal phi-sum1 begins, and it is cleared each time clear signal phi-cir (see FIG. 15(*d*)) begins.

Next, the numeral 123 shown in FIG. 12 indicates a multiplier which multiplies the output signal of interpolation controller 118 and the output signal of envelope generator 122. Envelope generator 122 generates a fixed envelope signal when key-on signal KON is supplied. By means of the multiplying process of multiplier 123, an envelope is given with respect to the interpolated waveform data. Then, the output signal of multiplier 123 is converted to an analog signal by means of D/A converter 125, and after this it is supplied to sound system 126, and a musical tone is generated.

C: Operation of the Preferred Embodiment

Next, the operation of the preferred embodiment in accordance with the above composition will be divided into the initial and repeating portions (see FIG. 17) and explained.

Musical Tone Operation of the Initial Portion

First, when one of the keys of keyboard 101 is depressed, the depression is detected by depression detecting circuit 102, and a key-on signal KON is outputted. By means of this, controller 105 sets signal ASEL to a "1" signal, and the first input end is selected by selector 109. As a result, start data SD are outputted through the medium of selector 109, subtractor 110, and shift register 111, and the integer portion I of this is supplied to the zeroth input end of selector 115. Here, since selector 115 selects the zeroth input end when clock signal phi-w is "0" (see FIG. 15(*a*)), the integer portion I of start data SD is supplied to waveform memory 117 through the medium of selector 115. As a result, the waveform data S(s) stored at the address shown by the integer portion I of start data SD are read out and supplied to interpolation controller 118. On the other hand, as A<B in comparer 112, signals CP1 and CP2 are not outputted; as a result, signal BSEL becomes a "0" signal. When signal BSEL becomes a "0" signal, the output signal of and-gate 132 shown in FIG. 13 always becomes an "0" signal. Then, in the case in which the output signal of and-gate 132 becomes "0," since selector 130 selects the zeroth input end, waveform data S(s) read out from waveform memory 117 are supplied to multiplier 133 through the medium of selector 130. Furthermore, in the case in which signal BSEL is a "0" signal, since selector 119, shown in FIG. 12, selects the zeroth input end, the fractional portion i of start data SD is outputted as interpolation coefficient data IPD from selector 119. In the timing in which clock signal phi-w becomes a "0" signal, interpolation coefficient data IPD are supplied to multiplier 133 through the medium of selector 135 after being bit-inverted by means of bit inverting circuit 136. When this fractional portion i is bit-inverted, since its value becomes (1−i), the waveform data S(s) at the address of the start data SD and (1−i) are multiplied in multiplier 133. The result of this multiplication {S(s)·(1−i)} are supplied to accumulating latch 137 through the medium of adder 134. Accumulating latch 137 has already been cleared by means of clock signal phi-cir (see time t1 of FIG. 15(*d*)); next, when clock signal sum1 begins at time t3 of FIG. 15(*b*), the above-mentioned result of the multiplication is introduced into accumulating latch 137. As a result, the result of the multiplication {S(s)·(1−i)} is supplied to input end B of adder 134.

Next, when clock signal phi-w begins at time t4, selector 115 shown in FIG. 12 selects the first input end. As a result, a value of the output signal of adder 116, in other words, start data SD, to which "1" has been added is supplied to waveform memory 117 through the medium of selector 115. By means of this, the waveform data S(s+1) of the address after start data SD are read out. These waveform data S(s+1) are supplied to multiplier 133 through the medium of selector 130 shown in FIG. 13. At this time, since clock signal phi-w is a "1" signal, selector 135 selects the first input end, and interpolation coefficient data IPD are supplied to multiplier 133 through the medium of selector 135. Since the interpolation coefficient data IPD of this case are the fractional portion i of start data SD, the result of the calculation in multiplier 133 is S(s+1)·i. In addition, the result of the multiplication is supplied to input end A of adder 134 and added to the prior multiplication result {S(s)·(1−i)}, which had already been supplied to input end B. The straight-line interpolation according to this addition is finished, and the straight-line interpolated data are introduced into output latch 138 when clock signal phi-sum2 begins, and are gradually outputted. Here, the conduction of the straight-line interpolation according to the calculation discussed above will be explained.

Figure 16:
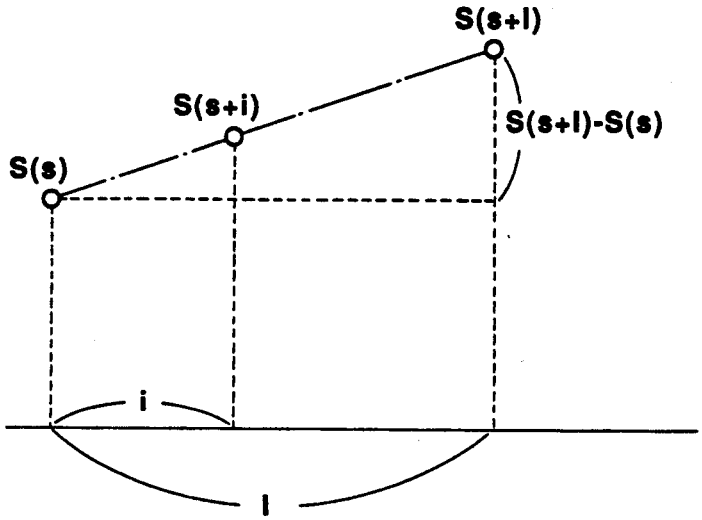
FIG. 16 is for the purpose of explaining the straight-line-interpolation processing in the same preferred embodiment.

Now, the waveform data S(s) at the address shown by the integer portion I of start data SD, and waveform data S(s+1) at the address shown by integer portion I of start data SD to which 1 has been added, are as shown in FIG. 16. In addition, when the fractional portion i of start data SD shown in the diagram are obtained, the waveform data S(s+i) which are to be obtained by the interpolation are given by the following formula.

$$S(s+i) = \frac{S(s+1)-S(s)}{1}\cdot i + S(s) \quad (4)$$
$$= i\cdot S(s+1) - i\cdot S(s) + S(s)$$
$$= (1-i)S(s) + i\cdot S(s+1)$$

The first multiplication on the right side of this formula (4) is carried out by multiplier 133 when clock signal phi-w is "0", and the second multiplication is carried out by multiplier 133 when clock signal phi-w is "1." Accordingly, when the results of the multiplications are added together in adder 134, the result of the calculation is equal to the right side of formula (4), and straight-line interpolation is carried out.

Next, the post-straight-line-interpolation data are outputted from output latch 138, envelope processing is carried out by multiplier 123, and after they have been converted to an analog signal by means of D/A converter 125, a musical tone is generated by sound system 126.

On the other hand, the start data SD read out from shift register 111 are supplied to the other input end of adder 108 shown in FIG. 12, and the F number outputted by F number register 104 is added. At this time, signal ASEL outputted by controller 105 becomes a "0" signal, and as a result, selector 109 selects the zeroth input end. By means of this, the result of the addition in adder 108 is outputted through the medium of selector 109, subtractor 110, and shift register 111. Then, waveform data readout and straight-line interpolation processing are carried out with respect to integer portion I and fractional portion i in the same manner as the case discussed above. Furthermore, since the output signal of shift register 111 is supplied to the other input end of adder 108, after this the F number is gradually accumulated according to this loop. Accordingly, waveform data readout and interpolation processing are carried out with respect to the integer portion I and the fractional portion i of the gradually accumulated data, and by means of this, the waveform data of the initial portion are created in accordance with this interpolation process. These waveform data of the initial portion are emitted as musical tones after the envelope processing mentioned above has been carried out.

Musical Tone Operation of the Repeating Portion

Next, the musical tone operation of the repeating portion will be explained. When the F numbers are gradually accumulated with regard to start data SD as in the above, the readout address of waveform 117 exceeds the area of the initial portion shown in FIG. 117 and enters the area of the repeating portion. Then, the waveform data readout and interpolation processing of the repeating portion are carried out in basically the same manner as in the case of the initial portion. However, as the accumulation of the F number proceeds and the output signal of shift register 111 comes to show an address between waveform data S(n+x−1) and loop end point address LEPA (hereinafter called the specified interpolation section) shown in FIG. 14, the content of the processing becomes different from that of the processing discussed above. This processing will be explained hereinafter.

First, when the output signal of adder 108 enters the specified interpolation section, A>int(B) in comparer 112. Since loop end point address LEPA is supplied to the B input end of comparer 112, int(B) becomes the integer portion of loop end point address LEPA. This integer portion of loop end point address LEPA is, as can be judged from FIG. 14(*a*), the address value of waveform data (S+x−1) and the initial point of the specified section. In addition, when the relationship A>int(B) comes about, comparer 112 outputs signal CP2, and by means of this, controller 105 makes signal BSEL a "1" signal, and outputs correction data CD. Here, correction data CD are set so that their inverse, 1/CD, is the fractional portion of loop end point address LEPA (see FIG. 14(*c*)).

When signal BSEL becomes a "1" signal, selector 119 shown in FIG. 12 selects the first input end, and as a result, the product i·CD of the fractional part of the output signal of shift register 111 and correction data CD is outputted as interpolation coefficient data IPD. Furthermore, when signal BSEL becomes a "1" signal, because this "1" signal is supplied to one input end of the and-gate 132 shown in FIG. 13, the output value of and-gate 132 is unmistakably determined by clock signal phi-w. Accordingly, when the clock signal phi-w is a "0" signal, selector 130 selects the zeroth input end, and the waveform data read out from waveform memory 117 are supplied to multiplier 133. Since the accumulated values of the F numbers have entered the specified interpolation section, the waveform data accessed by means of the integer value I are waveform data S(n+x−1), as can be judged from FIG. 14(*a*). Furthermore, since at this time selector 135 selects the zeroth input end, the bit-inverted value of i·CD is multiplied by waveform data S(n+x−1) in multiplier 133. Accordingly, the result of the multiplication of multiplier 133 becomes (1−i·CD)·S(n+x−1). This result of the multiplication is introduced into accumulating latch 137 gradually through the medium of the input end and output end A of adder 134, and is supplied to the input end B of adder 134. Next, when clock signal phi-w begins (see time t4 of FIG. 15(*a*)), and-gate 132 outputs a "1" signal, and selector 130 selects the first input end. As a result, the initial waveform data of the repeating portion which are stored in LS register 131, in other words, waveform data S(n), are supplied to multiplier 133. Furthermore, since when clock signal phi-w becomes a "1" signal, selector 135 selects the first input end, interpolation coefficient data IPD are supplied without change to multiplier 133. As a result, the result of the multiplication in multiplier 133 becomes S(n)·i·CD. This multiplication result is supplied to the input end A of adder 134 and added to the multiplication result of the previous time, which was already supplied to the input end B. Accordingly, the calculation S(n+x−1)·(1−i·CD)·CD+S(n)·i·CD is carried out in adder 134. Here, the meaning of this calculation will be explained.

Figure 18:
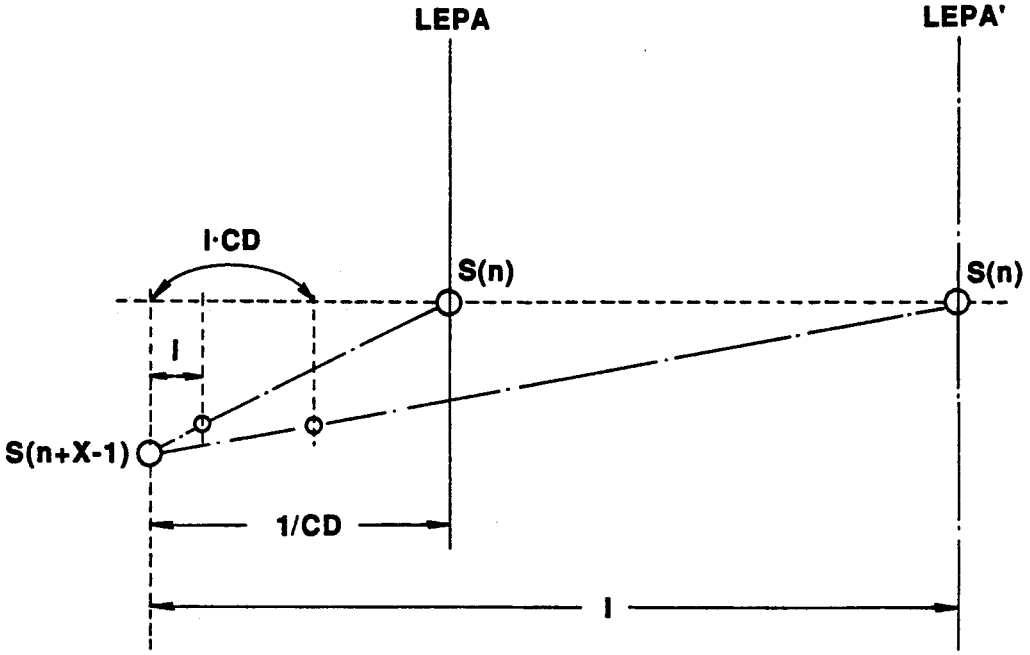
FIG. 18 is for the purpose of explaining the correction processing for specified interpolation sections in the same preferred embodiment.

First, in the present preferred embodiment, as stated above, waveform data S(n) of loop start point address LSPA are presumed to be in the position of loop end point address LEPA, and the interpolation of the specified interpolation section is carried out. The spacing of the specified interpolation section is 1/CD, as shown in FIG. 14(*c*); this is shorter than the spacing of other sections. With regard to the fractional portion i, it is necessary to perform an appropriate conversion with respect to the length of the section and divide by the section length 1/CD. Partically, this means multiplying the fractional portion i by CD; in other words, this becomes the same as treating the length of the specified interpolation section as "1" as in the case of the other sections. The state of this enlargement is shown in FIG. 18. In FIG. 18, loop end point address LEPA is shifted to the right side to become LEPA', and the length of the section becomes "1". If, with respect to this, the value of the fractional portion i is multiplied by CD, the formula (4) stated above can be applied with respect to the enlarged section and it can be seen that interpolation can be carried out. In other words, it is desirable to replace the i occurring on the right side of formula (4) with i·CD, to replace waveform data S(s) with S(n+x−1), and to replace waveform data S(s+1) with S(n). After these replacements, the right side corresponds to the calculation of adder 134, and it can be seen that an appropriate interpolation is carried out.

In addition, the result of the addition in adder 134 is introduced into output latch 138 at the beginning of clock signal phi-sum2 (see FIG. 15(*c*)) and is outputted to the later circuits.

Next, when the accumulation of the F numbers is carried out in adder 108 shown in FIG. 12, the same sort of processing as above is carried out with respect to these accumulated values. However, in the specified interpolation section, as FIG. 14(*a*) makes clear, the integer part I of the accumulated values (in other words, the output signal of shift register 111) shows an address at which unchanging waveform data S(n+x−1) are stored. In addition, since when clock signal phi-w is "1", selector 130 shown in FIG. 13 selects the first input end, interpolation takes place between S(n+x−1) and S(n) in the specified interpolation section in spite of fluctuations in the F number accumulated values. The fractional part of the F number accumulated value, in other words, the fractional portion i of the output signal of shift register 111, has an effect on the interpolation; interpolated values in accordance with the fluctuations in fractional portion i accompanying F number accumulation are gradually outputted from interpolation controller 118.

Figure 17:
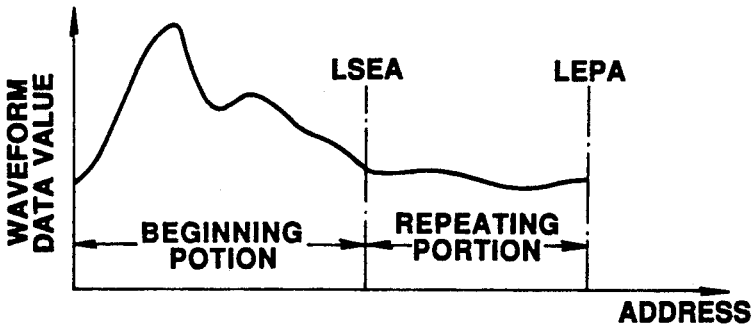
FIG. 17 is a waveform diagram showing the read-out waveform attack portion and the repeating portion in the same preferred embodiment.

Then, when the accumulated value of the F numbers grows large, this value exceeds the area of the repeating part (see FIG. 17). As a result, A>B in the comparer 112 shown in FIG. 12, and signal CP1 is outputted from comparer 112 to controller 105. When signal CP is supplied, controller 105 supplies signal RD to subtractor 110, and as a result, subtraction is carried out by subtractor 110. Here, since signal RD shows the size of the loop, and since when subtraction is carried out by subtractor 110, the address slightly exceeds loop end point address LEPA, the loop size is subtracted. Accordingly, the value of this calculation becomes the initial address of the repeating part; in other words, it has a value which is slightly larger than loop start point address LSPA. In this case, even if the subtraction value is not completely in agreement with loop start point address LSPA, since interpolation processing between waveform data S(n) of loop start point address LSPA and the waveform data in the subtraction value mentioned above is carried out by means of interpolation controller 118, problems do not occur. Then, after this the successive F numbers are accumulated with the subtraction value, and waveform data readout and interpolation identical to the above is carried out with respect to each accumulated value. Then, in the case in which the accumulated values again exceed loop end point address LEPA, subtraction is carried out by subtractor 110, and the vicinity of loop start point address LSPA is returned to. In this way, after this the waveform data are repeatedly read out and interpolation carried out in the repeating portion.

In the above operation, since the waveform data of the loop end point address LEPA are brought into agreement with the waveform data S(n) of loop start point address LSEA, no aberrations are generated in the interpolated values by means of the repetition of looping.

D: Modifications of the Preferred Embodiment

Figure 19A:
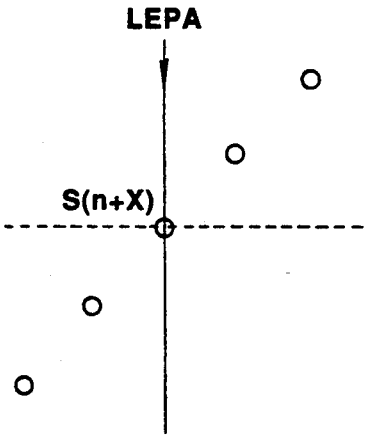
FIGS. 19(*a*) through 19(*c*) are conceptual diagrams showing the positional relationship between the boundary of the repeating portion and the waveform data in an example of a modification of the same preferred embodiment.
Figure 19B:
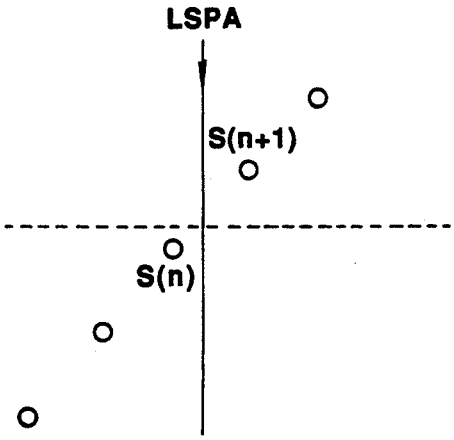
Figure 19C:
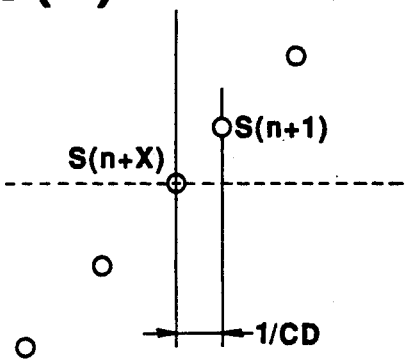
Figure 20:
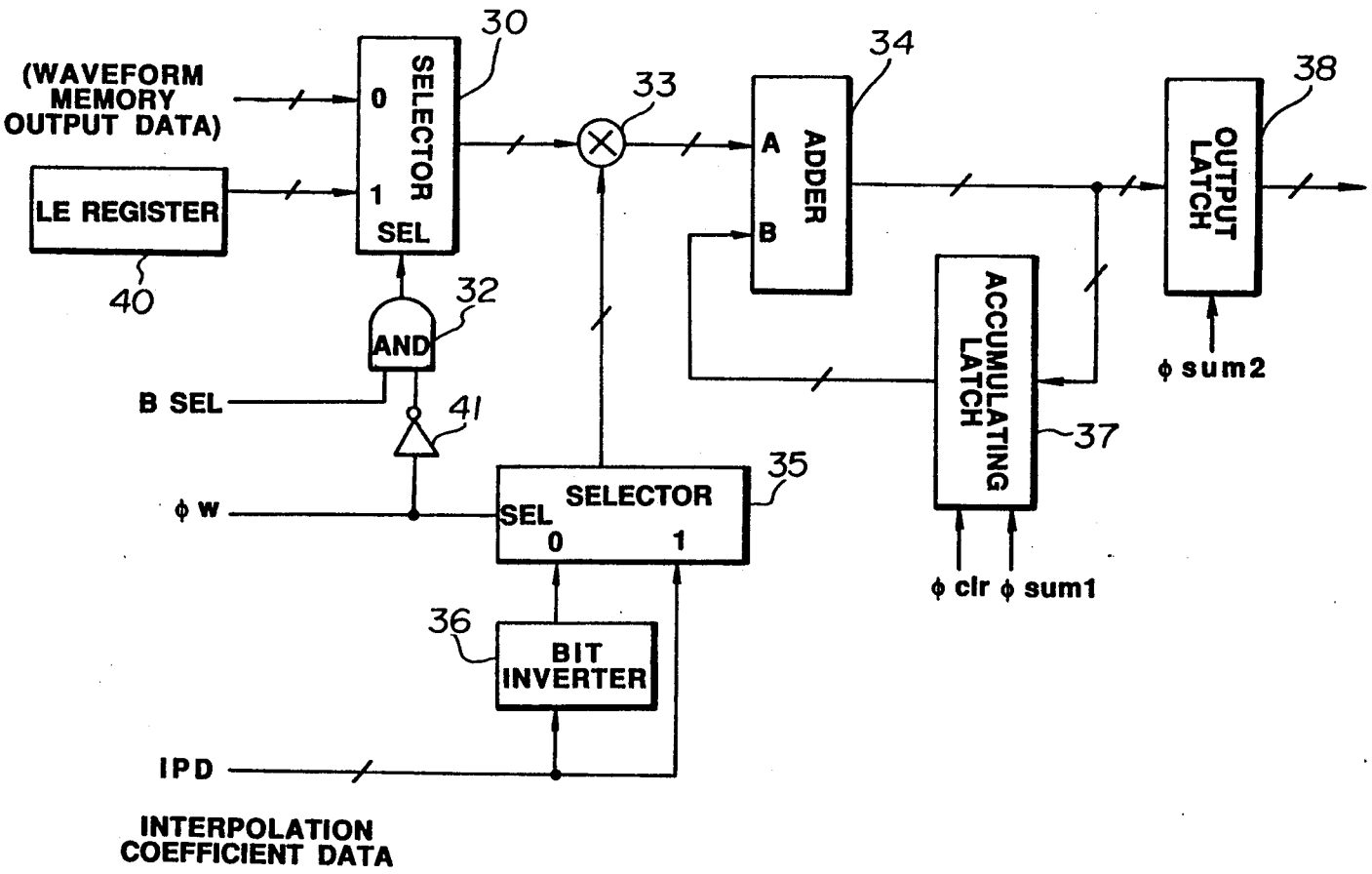
FIG. 20 is a block diagram showing an example of the construction of an interpolation controller in the same example of a modification of the same preferred embodiment.
Figure 23A:
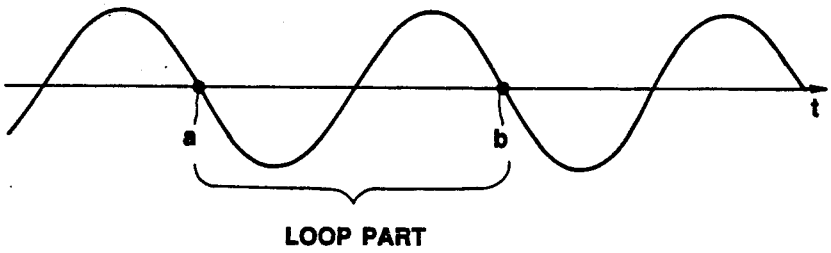
FIG. 23 is a waveform diagram for the purpose of explaining looping processing according to the pitch-synchronous method.
Figure 23B:
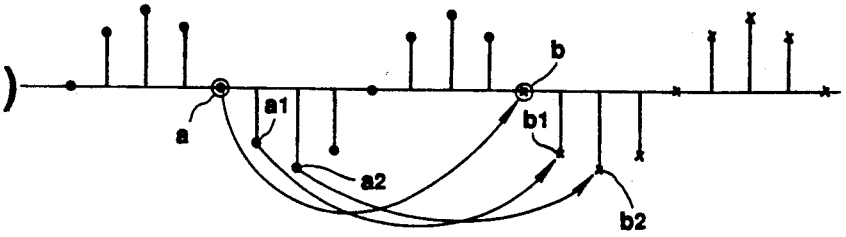
Figure 24A:
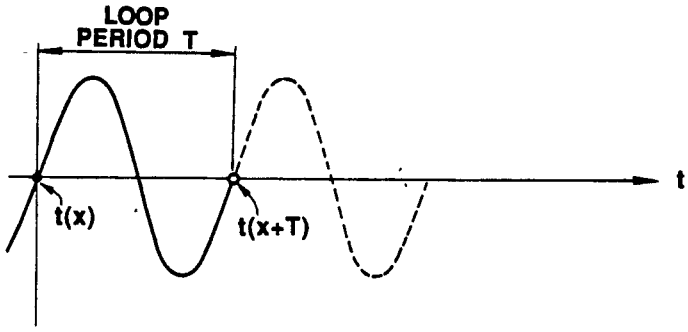
FIGS. 24(*a*) through 24(*d*) are waveform diagrams for the purpose of explaining conventional looping processing in a pitch-non-synchronous method.
Figure 24B:
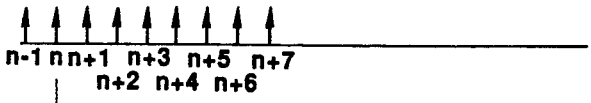
Figure 24C:
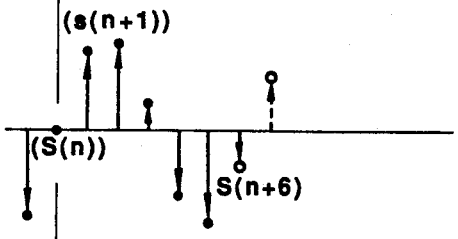
Figure 24D:
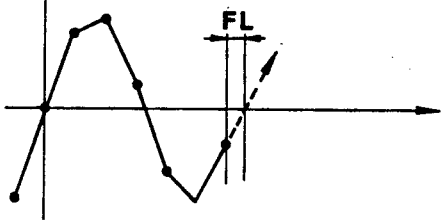

The above preferred embodiment is an example of a case in which there is no fractional portion i in loop start point address LSPA, while there is a fractional portion i in loop end point address LEPA (see FIG. 13(*a*) and (*b*)); however, even in an opposite case such as that shown in FIG. 19(*a*) and (*b*) in which loop start point address LSEA has a fractional portion i while loop end point address LEPA does not, it is possible to carry out processing identical to that of the preferred embodiment above. However, in this case, as shown in FIG. 19(*b*), waveform data of loop end point address LEPA are placed in the address position of loop start point address LSPA, and interpolation is carried out by means of these data. As a result of this, it is necessary to construct the interpolation controller 118 as shown in FIG. 20. The points in which the circuitry shown in FIG. 20 differs from the circuitry shown in FIG. 19 are that instead of LS register 131, an LE register 140 which stores the waveform data in loop end point address LEPA is provided, and that clock signal phi-w is supplied to one input end of and-gate 132 through the medium of inverter 141. Furthermore, signal BSEL shown in FIG. 20 becomes a "1" signal in the specified interpolation section shown in FIG. 19(*c*).

According to the above construction, in the specified interpolation period shown in FIG. 19(*c*), interpolation is carried out between waveform data S(n+x) and waveform data S(n+1). Since correction is carried out by means of correction data CD in the same way as in the above preferred embodiment, processing is as shown in FIG. 18 with respect to the extent of the specified interpolation section. Accordingly, according to the circuitry shown in FIG. 20, it is possible to obtain the same effect as in the above preferred embodiment.

What is claimed is:

1. A musical tone generating apparatus comprising:

a waveform memory which stores waveform data at a fixed sampling time;

an address data generator, which renews address data including an integer portion and a fractional portion corresponding to a frequency of a tone to be generated, accesses said waveform data according to said integer portion of said address and a following integer of said integer portion, and outputs said fractional portion of said address as interpolation data;

an interpolation controller, which carries out interpolation based on a plurality of waveform data accessed by said address data generator and said interpolation data; and a loop controller, which determines the repeating portion in one part of an address space constructed by said address data and controls said address data generator so that this repeating portion is repeatedly accessed, wherein in a final section of said repeating portion, said interpolation controller carries out interpolation using waveform data accessed by an integer portion which is directly before a repeating portion end address and waveform data of a repeating portion start address, and correcting said interpolation data in response to the distance between said integer portion and said repeating portion end address.

2. A musical tone generating apparatus comprising:

a waveform memory, which stores waveform data at a fixed sampling time;

an address data generator, which renews address data including an integer portion and a fractional portion corresponding to a frequency of a tone to be generated, accesses said waveform data according to said integer portion of said address and a following integer of said integer portion, and outputs said fractional portion of said address as interpolation data;

an interpolation controller, which carries out interpolation based on a plurality of waveform data accessed by said address data generator and said interpolation data; and a loop controller, which determines the repeating portion in one part of an address space constructed by said address data and controls said address data generator so that this repeating portion is repeatedly accessed, wherein in the first section of said repeating portion, said interpolation controller carries out interpolation using waveform data accessed by an integer portion which is directly after a repeating portion start address and waveform data of a repeating portion end address, and correcting said interpolation data in response to the distance between said integer portion and said repeating portion start address.

3. A musical tone generating apparatus comprising:

storing means for storing sample values of at least one musical tone waveform successively corresponding to a plurality of integer addresses;

command generating means for generating commands;

reading means for reading out said sample values successively from said storing means until a first predetermined address is reached, the reading means then successively reading out said sample values beginning from a second predetermined address in response to said commands; and determining means for determining said first and second predetermined addresses, wherein said determining means determines said first and second predetermined addresses including a fractional part as at least one of said first predetermined address and said second predetermined address in order to connect a waveform before the first predetermined address with a waveform after the second predetermined address, wherein the first predetermined address represents a loop end position and the second predetermined address represents a loop start position.

4. A musical tone generating apparatus comprising:

storing means for storing sample values of musical tone waveforms successively corresponding to integer addresses;

command generating means for generating commands;

reading means for reading out said sample values successively from said storing means until a first predetermined address is reached, the reading means then successively reading out said sample values beginning from a second predetermined address in response to said commands, wherein said first predetermined address represents a loop end position and the second predetermined address represents a loop start position;

first determining means for determining a value of a connection point; and second determining means for determining said first and second predetermined addresses, wherein said second determining means detects a particular sample whose value is equal to said value of said connection point among values of interpolated samples obtained by effecting interpolation on said sample values stored in said storing means, and determines addresses of said particular samples as at least one of said first predetermined address and said second predetermined address.

5. A musical tone generating apparatus comprising:

digitizing means for digitizing a musical tone;

first memory means for storing the digital data of the musical tone;

determining means for defining an initial portion and a repeating portion of the musical tone;

second memory means for storing data forming the initial portion of the musical tone;

digital data scanning means for determining a starting point of the repeating portion, for scanning and interpolating the digital data stored in the first memory means, and for determining an end point having an amplitude equal to the amplitude of the starting point of the repeating portion;

reading means for obtaining first and second address information corresponding to the starting point and the end point, respectively, of the repeating portion, and reading data of the repeating portion from the first memory means; and writing means for writing the data of the repeating portion into the second memory means.

6. A musical tone generating apparatus according to claim 5, wherein the digital data scanning means determines the starting point as a point having an amplitude equal to the amplitude of the end point of the initial portion, and address information corresponding to the starting point is used as loop-in point address information.

7. A musical tone generating apparatus comprising:

first memory means for storing digital waveform data of a musical tone having a plurality of cycles;

second memory means for storing first data for designating a loop start position in said first memory and second data for designating a loop end position in said first memory;

reading means for repeatedly reading said digital waveform data having a loop period designated by said first data and said second data, and outputting the read data for generating the musical tone;

determining means for determining said first data and second data, and writing said first data and second data into said second memory, said determining means comprising:

designating means for designating a position in said first memory as a first position;

searching means for searching for a position other than said first position in said first memory by interpolating said digital data stored in said first memory, the searching means identifying a position as the second position when the interpolated value of the digital data is substantially equal to the value of the digital data in said first position, and;

writing means for writing data stored at positions before one of said first position and second position as said first data into said second memory, and for writing data stored at positions after one of said first position and second position as said second data into said second memory.

8. A musical tone generating apparatus comprising:

first memory means for storing digital waveform data of a musical tone of plural cycle;

second memory means for storing first data for designating a loop start position in said first memory and second data for designating a loop end position in said first memory;

reading means for repeatedly reading said digital waveform data having a loop period designated by said first data and said second data, and outputting the read data for generating musical tone;

determining means for determining said first data and second data, and writing said first data and second data into said second memory, said determining means comprising:

designating means for designating a first position in said first memory as said loop start position;

searching means for searching for a second position after said loop start position in said first memory by interpolating said digital data stored in said first memory, the interpolated value of the digital data at the second position being equal to the value of the digital data at said loop start position, and designating the second position as said loop end position.

9. A musical tone generating apparatus comprising:

first memory means for storing digital waveform data of a musical tone of plural cycle;

second memory means for storing first data for designating a loop end position in said first memory and second data for designating a loop start position in said first memory;

reading means for repeatedly reading said digital waveform data having a loop period designated by said first data and said second data, and outputting the read data for generating musical tone;

determining means for determining said first data and second data, and writing said first data and second data into said second memory, said determining means comprising:

designating means for designating a first position in said first memory as said loop end position;

searching means for searching for a second position before said loop end position in said first memory by interpolating said digital data stored in said first memory, the interpolated value of the digital data at the second position being equal to the value of the digital data at said loop end position, and designating the second position as said loop start position.

* * * * *